US008524037B2

(12) United States Patent
Heer et al.

(10) Patent No.: US 8,524,037 B2
(45) Date of Patent: Sep. 3, 2013

(54) CONTINUOUS DIGESTION OF CHIP BLENDS CONTAINING A WESTERN RED CEDAR CHIP FURNISH

(75) Inventors: Ranbir Heer, Vancouver (CA); Paul Watson, Vancouver (CA)

(73) Assignee: Canfor Pulp and Paper Sales Ltd., Vancouver, B.C. (CA)

( * ) Notice: Subject to any disclaimer, the term of this patent is extended or adjusted under 35 U.S.C. 154(b) by 189 days.

(21) Appl. No.: 13/009,762

(22) Filed: Jan. 19, 2011

(65) Prior Publication Data

US 2011/0186250 A1 Aug. 4, 2011

Related U.S. Application Data

(60) Provisional application No. 61/300,397, filed on Feb. 1, 2010.

(51) Int. Cl.
*D21C 3/26* (2006.01)

(52) U.S. Cl.
USPC ..... 162/17; 162/91

(58) Field of Classification Search
USPC ..... 162/17, 91
See application file for complete search history.

(56) References Cited

U.S. PATENT DOCUMENTS

2006/0196622 A1* 9/2006 Trung et al. ..... 162/49
2008/0110584 A1* 5/2008 Yin ..... 162/9

OTHER PUBLICATIONS

Kelsey et al, Changes in Heartwood Chemistry of Dead Yellow Cedar trees that remain Standing for 80 Years or More in Southeast Alaska; Joutnal of Chemical Ecology, vol. 31, No. 11 Nov. 2005 pp. 2653-2670.*

Martin MacLeod, The top ten factors in Kraft pulp yield, Paper and Timber vol. 89 Apr. 2007.*

Gullichsen, Johan, Introduction in: Chemical Pulping, Papermaking Science and Technology Series, Book 6A, 1999, A14-A16, Fapet Oy, Helsinki.

Gullichsen, Johan, Fiber Line Operations in: Chemical Pulping, Papermaking Science and Technology Series, Book 6A, 1999, A18-A243, Fapet Oy, Helsinki.

Uusitalo, Paivi and Svedman, Mikael, Batch Cooking Applications in: Chemical Pulping, Papermaking Science and Technology Series, Book 6A, 1999, A492-A511, Fapet Oy, Helsinki.

Marcoccia, Bruno et al., Continuous Cooking Applications in: Chemical Pulping, Papermaking Science and Technology Series, Book 6A, 1999, A512-A570, Fapet Oy, Helsinki.

Pikka, Olavi et al., Pulp Washing Applications in: Chemical Pulping, Papermaking Science and Technology Series, Book 6A, 1999, A572-A601, Fapet Oy, Helsinki.

Ljokkoi, Risto et al., Pulp Screeing Applications in: Chemical Pulping, Papermaking Science and Technology Series, Book 6A, 1999, A603-A615, Fapet Oy, Helsinki.

(Continued)

*Primary Examiner* — Eric Hug
*Assistant Examiner* — Jacob Thomas Minskey
(74) *Attorney, Agent, or Firm* — Bozicevic, Field & Francis LLP; Bret E. Field; Benjamin C. Pelletier

(57) ABSTRACT

A process is provided for delignifying lignocellulosic material, including feeding a lignocellulosic blend comprising a Western Red Cedar (WRC) chip furnish and a second lignocellulosic material into an aqueous alkaline pulping solution at the feed end of a digester to produce a lignocellulosic mass. The second lignocellulosic material is provided in a proportion that increases the density of the mass to enable the mass to move through the digester while minimizing production effects associated with low density WRC chips. The mass moves through the digester to produce a pulp that may be bleached.

22 Claims, 22 Drawing Sheets

(56) References Cited

OTHER PUBLICATIONS

Pikka, Olavi et al., Bleaching Applications in: Chemical Pulping, Papermaking Science and Technology Series, Book 6A, 1999, A616-A665, Fapet Oy, Helsinki.
TAPPI T236 om-99, *Kappa number of pulp*, Pulp Properties Committee of the Process and Product, 1999.
TAPPI T231 cm-96, *Zero-span breaking strength of pulp* (*dry zero-span tensile*), Pulp Properties Committee of the Process and Product, 1996.
TAPPI T232 cm-01, *Fiber length of pulp by projection*, Pulp Properties Committee of the Process and Product, 2001.
TAPPI T233 cm-95, *Fiber length of pulp by classification*, Pulp Properties Committee of the Process and Product, 1995.
TAPPI T271 om-92, *Fiber length of pulp and paper by automated optical analyzer using polarized light*, Pulp Properties Committee of the Process and Product, 1992.
TAPPI T234 cm-02, *Coarseness of pulp fibers*, Pulp Properties Committee of the Process and Product, 2002.
TAPPI T230 om-99, *Viscosity of pulp* (*capillary viscometer method*), Pulp Properties Committee of the Process and Product, 1999.
TAPPI T248 sp-00, *Laboatory beating of pulp* (*PFI mill method*), Pulp Properties Committee of the Process and Product, 2000.
TAPPI T221 cm-99, *Drainage time of pulp*, Pulp Properties Committee of the Process and Product, 1999.
TAPPI T227 om-99, *Freeness of pulp* (*Canadian standard method*), Pulp Properties Committee of the Process and Product, 1999.
TAPPI T494 om-01, *Tensile properties of paper and paperboard* (*using constant rate of elongation apparatus*), Pulp Properties Committee of the Process and Product, 2001.
TAPPI T414 om-98, *Internal tearing resistance of paper* (*Elmendorf-type method*), Pulp Properties Committee of the Process and Product, 1998.
TAPPI T403 om-02, *Bursting strength of paper*, Pulp Properties Committee of the Process and Product, 2002.
TAPPI T452 om-02, *Brightness of pulp, paper, and paperboard* (*directional reflectance at 457 nm*), Pulp Properties Committee of the Process and Product, 2002.
TAPPI T460 om-02, *Air resistance of paper* (*Gurley method*), Pulp Properties Committee of the Process and Product, 2002.
TAPPI T538 om-01, *Roughness of paper and paperboard* (*Sheffield method*), Pulp Properties Committee of the Process and Product, 2001.
TAPPI T220 sp-01, *Fiber analysis of paper and paperboard*, Pulp Properties Committee of the Process and Product, 2001.
TAPPI T401 om-03, *Physical testing of pulp handsheets*, Pulp Properties Committee of the Process and Product, 2003.
Standard B.7, *Quantitative Analysis of Fibre Mixtures by Light Microscopy*, Standard Methods Committee of the Pulp and Paper Technical Association of Canada, 2011.
Standard B.2P, *Preparation of Slides for the Microscopic Examination of Fibers*, Standard Methods Committee of the Pulp and Paper Technical Association of Canada, 2005.
ISO 5267-2, *Pulps—Determination of drainability—Part 2: "Canadian standard" freeness method* (*2ed*), International Organization for Standardization, 2001.
ISO 5264-2, *Pulps—Laboratory beating—Part 2: PFI mill Method* (*3ed*), International Organization for Standardization, 2011.
ISO 5267-1, *Pulps—Determination of drainability—Part 1: Schopper-Riegler method* (*2ed*), International Organization for Standardization, 1999.

* cited by examiner

CONTINUOUS DIGESTION OF CHIP BLENDS CONTAINING A WESTERN RED CEDAR CHIP FURNISH

CROSS-REFERENCE TO RELATED APPLICATIONS

Pursuant to 35 U.S.C. §119 (e), this application claims priority to the filing dates of: U.S. Provisional Patent Application Ser. No. 61/300,397 filed on Feb. 1, 2010; the disclosure of which application is herein incorporated by reference.

INTRODUCTION

The production of cellulosic pulp from lignocellulosic materials is well known and may involve mechanical, chemical, and thermal processes, or various combinations of such processes, to produce cellulosic materials that can be manufactured into various products, for example, paper. Chemical pulping is an economically attractive process due to high pure cellulose fibre (pulp) yields and the resultant fibre properties which are applicable to a wide variety of end-use applications.

In a typical chemical pulping process, comminuted lignocellulosic materials are subjected to chemical reagents that remove lignin, hemicellulose, gums, carbohydrates, and fatty materials from the lignocellulosic materials to release cellulose fibers during the digestion process. The dominant chemical pulping process is currently the "kraft", or "sulphate", process. In the kraft process, sodium hydroxide and sodium sulfite comprise the principal cooking or digestive chemicals ("cooking liquor") which, when mixed with water at specified levels, are generally referred to as "alkaline pulping liquor" or "white liquor". The alkaline reagents react with lignin, hemicellulose and other resin molecules to break them into smaller fragments whose sodium salts are soluble or dispersible in the cooking liquor.

In the kraft process, a select amount of the lignocellulosic material, e.g. wood chips, is fed to a digester vessel along with white liquor to attain a select "chemical" or "liquid-to-wood" ratio. This material charge is then subjected to controlled heat and pressure over a select period of time.

Both batch and continuous digestion processes are known. In batch processes, the material charged may be held in a vessel (a "batch digester") under select temperature/pressure condition for a calculated period of time to attain a desired pulp characteristic, typically residual lignin content, and then "discharged" or "blown" into a holding tank so as to yield a pulp suitable for further processing, including washing, and/or bleaching, prior to paper manufacturing. In a continuous digestion process, the material charge is controllably moved through zones of select temperature/pressure to a regulated discharge point (i.e. a valve) to continuously yield pulp having desired characteristics (i.e. a select level of delignification, reduced "resins" content, water drainability, etc.).

Bleached kraft pulp prepared from chip furnishes comprising greater than 90% fine-fibered, low coarseness *Thuja plicata* (Western Red Cedar; "WRC") by oven dried weight, or high-WRC ("HRWC") pulp, is highly prized worldwide for unique high value end product applications owing to the unique combination of pulp fibre properties. One example is in medical specialty applications where highly closed sheet composites prepared with HWRC pulps guarantee a fluid barrier.

The production of WRC-containing pulps from chip furnishes exceeding 40% WRC by oven dried weight is generally confined to batch pulping systems due to low wood density, low pulp yield, corrosivity of the residual ("black") liquors, significant issues with chip plug movement in continuous digesters, and plugging of liquor extraction screens by fine cedar fibers that detach from the chips during pulping.

SUMMARY

In accordance with one aspect of the invention, there is provided a continuous process for delignifying lignocellulosic material. The process includes feeding a lignocellulosic blend comprising a *Thuja plicata* chip furnish and a second lignocellulosic material into an aqueous alkaline pulping solution at the feed end of a digester to produce a lignocellulosic mass. The second lignocellulosic material is provided in a proportion that increases the density of the mass so as to enable the mass to move through the continuous digester while minimizing production effects associated with low density WRC chips. Accordingly the mass moves through the digester to produce a cellulosic pulp having a pre-bleaching kappa of no greater than 30 under conditions having an H-Factor of 1500 or greater. The continuous process further includes recovering the cellulosic pulp at a recovery end of the digester, such that it may be subsequently bleached to produce a bleached pulp having a post-bleaching kappa of 5 or less, a yield of 38% or greater, a length weighted fiber length 2.2 mm or less, a coarseness of 0.16 mg/m or less, a freeness of 610 mL or less, a tensile strength of 8.0 km or greater at 500 CSF, and a porosity of 60 Gurley sec or less at 500 CSF.

The process may further include a further step of bleaching the cellulosic pulp to produce a bleached pulp having a post-bleaching kappa of 5 or less, a yield of 38% or greater, a length weighted fiber length of 2.2 mm or less, a coarseness of 0.16 mg/m or less, a freeness of 610 mL or less, a tensile strength of 8.0 km or greater at 500 CSF, and a porosity of 60 Gurley sec or less at 500 CSF. The bleached pulp may have a post-bleaching kappa greater than zero, a length weighted fiber length of 1.8 mm or greater, a freeness of 550 mL or greater, a tensile strength of 9.5 km or less at 500 CSF, and a porosity of 20 Gurley sec or greater at 500 CSF.

*Thuja plicata* fibers may make up 80% or less of the fibers of the cellulosic pulp. Alternatively, *Thuja plicata* fibers may make up less than 70%, 60%, or 50% of the fibers of the cellulosic pulp. *Thuja plicata* chips may make up less than 80% of the chip furnish by oven dry weight. Alternatively, *Thuja plicata* chips may make up less than 70% 60%, or 50% of the chip furnish by oven dry weight. The second source of lignocellulosic material may be a *Callitropsis nootkatensis*.

According to another aspect of the invention, there is provided a process for delignifying lignocellulosic material. The process includes feeding a lignocellulosic blend comprising a *Thuja plicata* chip furnish and a second lignocellulosic material into an aqueous alkaline pulping solution in a digester to produce a lignocellulosic mass. The *Thuja plicata* chip furnish will make up 85% or less of the blend by oven dry weight. The process further includes producing a cellulosic pulp under conditions having an H-Factor of 1500 or greater, and recovering the cellulosic pulp from the digester, wherein the cellulosic pulp has a kappa of 30 or less with a yield of 38% or greater. The cellulosic pulp may be subsequently bleached to produced a bleached pulp having a post-bleaching kappa of 5 or less, a length weighted fiber length of 2.2 mm or less, a coarseness of 0.16 mg/m or less, a freeness of 610 mL or greater, a tensile strength of 8.0 km or greater at 500 CSF, and a porosity of 60 Gurley sec or less at 500 CSF.

The process may further include a subsequent step of bleaching the cellulosic pulp to produce a bleached pulp having a post-bleaching kappa of 5 or less, a length weighted fiber length of 2.2 mm or less, a coarseness of 0.16 mg/m or less, a freeness of 610 mL or less, a tensile strength of 8.0 km or greater at 500 CSF, and a porosity of 60 Gurley sec or less at 500 CSF. The bleached pulp may have a post-bleaching kappa greater than zero, a length weighted fiber length 1.8 mm or greater, a freeness of 550 mL or greater, a tensile strength 9.5 km or less at 500 CSF, and a porosity of 20 Gurley sec or greater at 500 CSF.

The process may be a continuous process. *Thuja plicata* fibers may make up 85% or less of the fibers of the cellulosic pulp. Alternatively, *Thuja plicata* fibers may make up less than 80%, 70%, 60%, or 50% of the fibers of the cellulosic pulp. *Thuja plicata* chips may make up less than 80% of the chip furnish by oven dry weight. Alternatively, *Thuja plicata* chips may make up less than 70%, 60%, or 50% of the chip furnish by oven dry weight. The second source of lignocellulosic material may be a *Callitropsis nootkatensis.*

According to another aspect of the invention, there is provided a use of a lignocellulosic blend comprising a *Thuja plicata* chip furnish and a second lignocellulosic material in the preparation of a cellulosic pulp by continuous process. The use includes feeding the lignocellulosic blend into an aqueous alkaline pulping solution at a feed end of a digester to produce a lignocellulosic mass. The second lignocellulosic material is provided in a proportion that increases the density of the mass so that the mass sinks in the pulping solution. Accordingly the mass moves through the digester to produce a cellulosic pulp having a fully or semi-bleached pre-bleaching kappa of no greater than 30 under conditions having an H-Factor of 1500 or greater. The use further includes recovering the cellulosic pulp at a recovery end of the digester, such that it may be subsequently bleached to produce a bleached pulp having a post-bleaching kappa of 5 or greater, a yield of 38% or greater, a length weighted fiber length of 2.2 mm or less, a coarseness of 0.16 mg/m or less, a freeness of 610 mL or less, a tensile strength of 8.0 km or greater at 500 CSF, and a porosity of 60 Gurley sec or less at 500 CSF.

The use may further include a further step of bleaching the cellulosic pulp to produce a bleached pulp having a post-bleaching kappa of 5 or less, a yield of 38% or greater, a length weighted fiber length of 2.2 mm or less, a coarseness of 0.16 mg/m or less, a freeness of 610 mL or less, a tensile strength of 8.0 km or greater at 500 CSF, and a porosity of 60 Gurley sec or less at 500 CSF. The bleached pulp may have a post-bleaching kappa greater than zero, a length weighted fiber length of 1.8 mm or greater, a freeness of 550 mL or greater, a tensile strength of 9.5 km or less at 500 CSF, and a porosity of 20 Gurley sec or greater at 500 CSF.

*Thuja plicata* fibers may make up 80% or less of the fibers of the cellulosic pulp. Alternatively, *Thuja plicata* fibers may make up less than 70%, 60%, or 50% of the fibers of the cellulosic pulp. *Thuja plicata* chips may make up less than 80% of the chip furnish by oven dry weight. Alternatively, *Thuja plicata* chips may make up less than 70% 60%, or 50% of the chip furnish by oven dry weight. The second source of lignocellulosic material may be a *Callitropsis nootkatensis.*

In accordance with yet another aspect of the invention, there is provided a use of a lignocellulosic blend, including a *Thuja plicata* chip furnish and a second lignocellulosic, material in the preparation of a cellulosic pulp. The use includes feeding the lignocellulosic blend into an aqueous alkaline pulping solution in a digester to produce a lignocellulosic mass. The *Thuja plicata* chip furnish makes up 85% or less of the blend by oven dry weight. The use further includes producing a fully or semi-bleached pre-bleached cellulosic pulp under conditions having an H-Factor of 1500 or greater, and recovering the cellulosic pulp from the digester, wherein the pre-bleached cellulosic pulp has a pre-bleaching kappa of 30 or lower with a yield of 38% or greater. The cellulosic pulp may be subsequently bleached to produced a bleached pulp having a post-bleaching kappa of 5 or less, a length weighted fiber length of 2.2 mm or less, a coarseness of 0.16 mg/m or less, a freeness of 610 mL or less, a tensile strength of 8.0 km or greater at 500 CSF, and a porosity of 60 Gurley sec or less at 500 CSF.

The use may further include subsequent bleaching the pre-bleached cellulosic pulp to produce a bleached pulp having a post-bleaching kappa of 5 or less, a length weighted fiber length of 2.2 mm or less, a coarseness of 0.16 mg/m or less, a freeness of 610 mL or less, a tensile strength of 8.0 km or less at 500 CSF, and a porosity of 60 Gurley sec or less at 500 CSF. The bleached pulp may have a post-bleaching kappa greater than zero, a length weighted fiber length of 1.8 mm or more, a freeness of 550 mL or more, a tensile strength of 9.5 km or less at 500 CSF, and a porosity of 20 Gurley sec or greater at 500 CSF.

The use may be with a continuous digester. *Thuja plicata* fibers may make up 85% or less of the fibers of the cellulosic pulp. Alternatively, *Thuja plicata* fibers may make up 80%, 70%, 60%, or 50% or less of the fibers of the cellulosic pulp. *Thuja plicata* chips may make up 80% or less of the chip furnish by oven dry weight. Alternatively, *Thuja plicata* chips may make up 70%, 60%, or 50% or less of the chip furnish by oven dry weight. The second source of lignocellulosic material may be a *Callitropsis nootkatensis.*

In accordance with another aspect of the invention, there is provided a bleached pulp produced according to a continuous process for delignifying lignocellulosic material. The process includes feeding a lignocellulosic blend comprising a *Thuja plicata* chip furnish and a second lignocellulosic material into an aqueous alkaline pulping solution at the feed end of a digester to produce a lignocellulosic mass. The second lignocellulosic material is provided in a proportion that increases the density of the mass so that the mass sinks in the pulping solution. Accordingly the mass moves through the digester to produce a fully or semi-bleached cellulosic pulp having a pre-bleaching kappa of 30 or less under conditions having an H-Factor of 1500 or greater. The continuous process further includes recovering the cellulosic pulp at a recovery end of the digester, and subsequent bleaching to produce a bleached pulp having a post-bleaching kappa of 5 or less, a yield of 38% or more, a length weighted fiber length of 2.2 mm or less, a coarseness of 0.16 mg/m or less, a freeness of 610 mL or less, a tensile strength of 8.0 km or more at 500 CSF, and a porosity of 60 Gurley sec or less at 500 CSF. The bleached pulp may have a post-bleaching kappa greater than zero, a length weighted fiber length of 1.8 mm or greater, a freeness of 550 mL or less, a tensile strength of 9.5 km or less at 500 CSF, and a porosity of 20 Gurley sec or greater at 500 CSF.

*Thuja plicata* fibers may make up 80% or less of the fibers of the bleached pulp. Alternatively, *Thuja plicata* fibers may make up 70%, 60%, or 50% or less of the fibers of the cellulosic pulp. *Thuja plicata* chips may make up 80% or less of the chip furnish by oven dry weight. Alternatively, *Thuja plicata* chips may make up 70% 60%, or 50% or less of the chip furnish by oven dry weight. The second source of lignocellulosic material may be a *Callitropsis nootkatensis.*

In accordance with another aspect of the invention, there is provided a bleached pulp produced according to a process for delignifying lignocellulosic material. The process includes feeding a lignocellulosic blend comprising a *Thuja plicata* chip furnish and a second lignocellulosic material into an aqueous alkaline pulping solution in a digester to produce a lignocellulosic mass. The process may be a continuous process. The *Thuja plicata* chip furnish will make up 85% or less of the blend by oven dry weight. The process further includes producing a fully or semi-bleached cellulosic pulp under conditions having an H-Factor of 1500 or greater, and recovering the fully or semi-bleached cellulosic pulp from the digester, wherein the cellulosic pulp has a pre-bleaching kappa of 30 or less with a yield of 38% or greater. The cellulosic pulp is subsequently bleached to produced a bleached pulp having a post-bleaching kappa of 5 or less, a length weighted fiber length of 2.2 mm or less, a coarseness of 0.16 mg/m or less, a freeness of 610 mL or less, a tensile strength of 8.0 km or greater at 500 CSF, and a porosity of 60 Gurley sec or less at 500 CSF.

The bleached pulp may have a post-bleaching kappa greater than zero, a length weighted fiber length of 1.8 mm or greater, a freeness of 550 mL or more, a tensile strength of 9.5 km or less at 500 CSF, and a porosity of 20 Gurley sec or greater at 500 CSF.

*Thuja plicata* fibers may make up 85% or less of the fibers of the cellulosic pulp. Alternatively, *Thuja plicata* fibers may make up 80%, 70%, 60%, or 50% or less of the fibers of the cellulosic pulp. *Thuja plicata* chips may make up 80% or less of the chip furnish by oven dry weight. Alternatively, *Thuja plicata* chips may make up 70%, 60%, or 50% or less of the chip furnish by oven dry weight. The second source of lignocellulosic material may be a *Callitropsis nootkatensis*.

DETAILED DESCRIPTION

Figure 1:
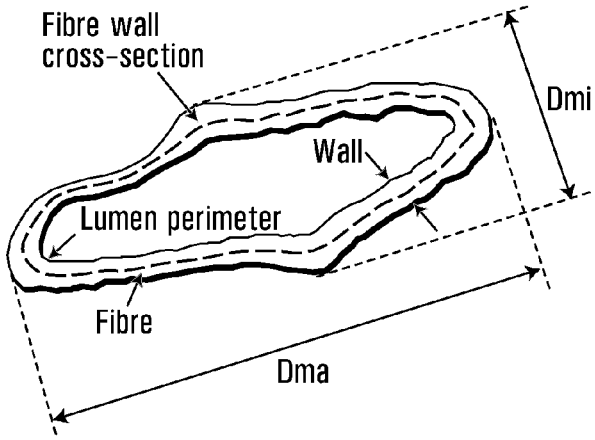
FIG. 1 shows a cross-sectional schematic diagram of a lignocellulosic fiber.

In various embodiments, the invention provides processes for producing a HWRC-like pulp from lignocellulosic materials comprising 85% or less WRC by oven dry (OD) weight under conditions having an H-factor of 1500 or greater.

Definitions and General Information

As used herein, "lignocellulosic material" refers to any material comprising mainly cellulose, hemicellulose, and lignin. "Cellulose" is an unbranched polysaccharide consisting of a linear chain of several hundred to over ten thousand β(1→4) linked D-glucose units, and is the main structural component of plant and algal cell walls. Cellulose comprises about 33% of plant matter, and about 35-60% of natural lignocellulosic materials. "Hemicellulose" is non-cellulosic polysaccharides associated with cellulose in plant tissues. Hemicellulose comprises about 20-35% w/w of natural lignocellulosic materials, consisting predominantly of D-pentose (five-carbon) sugar units, mostly xylose, although more minor proportions of hexose (six-carbon) sugar units, are generally also present. "Lignin" is a complex cross-linked polymer based on variously substituted p-hydroxyphenylpropane units, and generally constitutes about 25-33% w/w of natural lignocellulosic materials. It is covalently linked to cellulose and hemicellulose, and consequently confers mechanical strength to the cell wall, and the plant as a whole, by crosslinking different plant polysaccharides, The cellulosic fibers can be separated from the lignocellulosic raw material, e.g. wood, by chemical or mechanical defiberizing processes referred to as "pulping". Pulping processes are generally known in the art.

As used herein, "cellulosic pulp" or "pulp" is a dry fibrous material prepared by chemical or mechanical pulping of lignocellulosic materials. Cellulosic pulp which is formed into sheets to be shipped and sold as cellulosic pulp, and not further processed into paper at the same location, is referred to as "market pulp".

As used herein, "chemical pulp" refers to cellulosic pulp produced by combining lignocellulosic materials and chemicals in large pressure vessels known as "digesters" where heat, pressure, and the chemicals break down bonds that link lignin to the cellulose binding without seriously degrading the cellulose fibers. As used herein, "chemical cooking" or "cooking" is the process of exposing the lignocellulosic material to chemicals under heat and pressure to break down the lignin.

The "kraft process", also known as "kraft pulping" or the "sulfate process", is the dominant chemical pulping method in the world. As used herein, the "kraft process" refers to a process of cooking lignocellulosic material with a mixture of sodium hydroxide and sodium sulfide, thereby converting the lignocellulosic material into a cellulosic pulp comprised of almost pure cellulose fibers.

As used herein, a "batch chemical pulping process" or "batch cooking process" or "batch process" is a process in which discrete quantities of lignocellulosic material are individually processed. Industrial batch processes, including "conventional" batch processes and "displacement" batch processes, are well known in the art and are described in Papermaking Science and Technology Series, Book 6A "Chemical Pulping", Eds. Johan Gullichsen and Hannu Paulapuro, Fapet Oy, 1999. In a batch process, a "batch digester" is filled with lignocellulosic material before being charged with the cooking liquor. Chips may be transported from storage to the digester by belt conveyors. A known amount of dry wood will be charged into the digester to obtain a uniform degree of delignification from cook to cook. Chip mass may be measured, for example, by strain gauges in the digester legs. Accurate measurement of chip moisture is necessary to determine the appropriate alkali charge, which is based on the amount of dry wood in the digester. Proper chip packing and distribution is also important for uniform cooking and can be attained, for example, by steam packing. The digester is then sealed and, with steam and/or hot black liquor, the temperature of the digester is brought up to a cooking temperature at which the digester is maintained for a period of time referred to as "the cook". At the conclusion of the cook, a "blow" valve in the digester is opened, and the contents of the digester are then discharged into a "blow tank".

As used herein, a "continuous chemical pulping process" or "continuous cooking process" or "continuous process" is a method of chemical cooking in which raw lignocellulosic materials and cooking liquors are continuously fed at controlled rates into a pressurized digester at a "feed end" while at the same time pulp and black liquor (i.e. the combined cooking liquids that contain the lignin fragments, carbohydrates from the breakdown of hemicellulose, sodium carbonate, sodium sulfate and other inorganic salts) are removed at a "recovery end". Continuous processes, including modified kraft cooking (MCC), isothermal cooking (ITC), Lo-Level™ feed system, and Lo-Solids™, are well known in the art and are described, for example, in Papermaking Science and Technology Series, Book 6A "Chemical Pulping", Eds. Johan Gullichsen and Hannu Paulapuro, Fapet Oy, 1999. Digesters for a continuous process include the type supplied by Kamyr, Inc. of Glens Falls, N.Y. or Kamyr AB of Karlstad, Sweden.

In continuous processes, the lignocellulosic materials move down through successive cooking zones within the digester and are continuously discharged at the bottom as pulp. Lignocellulosic materials may be fed into the digester via conveyor belts to a chip bin which may employ atmospheric pre-steaming to heat the lignocellulosic materials for the purpose of removing entrained air, thereby preparing the lignocellulosic materials to subsequently absorb the cooking liquors uniformly and allowing the chips to sink in the digester. The steamed chips may be discharged from the bottom of the bin at a controlled rate by a rotary feeder, with a variable speed drive called a "chipmeter", into a horizontal steaming vessel that conveys and discharges the chips into a vertical chute. In a continuous process, the lignocellulosic materials are fed at a rate which allows the pulping reaction to be complete by the time the materials exit the digester.

A vertical chute may be used to feeds chips into the inlet of a high pressure feeder where the chips initially contact the cooking liquor. Chips are flushed with liquor to the top of the digester vessel where they form a chip column that moves vertically down. Gravity draws the chip column downward according to the difference in density between the column and the unbound liquor. While chips and bound liquor move down, unbound liquor can move in any direction or velocity relative to the chip column. The top of the digester is generally an impregnation zone, where the chips are retained for 45-60 minutes, with a series of digester screens below that allow selective extraction of unbound liquor. Immediately below the impregnation zone is a heating zone where the column undergoes indirect heating using external liquor heat circulation to bring the chip column to full cooking temperature. Beneath the heating circulations is a concurrent cooking zone, where chips may be maintained, for example, for 1.5-2.5 h. Below this is the extraction zone where unbound liquor is removed from the system. An upward flow of unbound liquor is generated beneath the extraction zone to create a counter current washing zone, where chips may be further retained for 1-4 h. Finally, a blow and cooling zone is located at the bottom of the digester where cooled chips may be discharged from the bottom of the digester using an outlet scraping device.

Delignification may typically require several hours at temperatures ranging from 130 to 180° C. Under these conditions, the lignin and hemicellulose may degrade to give fragments that dissolve in the alkaline cooking liquid. The remaining pulp (about 40-48% by weight based on the dry wood chips), once collected in a blow tank in a batch process or at the recovery end of the digester in a continuous process, is known as "brown stock".

Certain cellulosic fibers will give paper, and related products, specific desirable properties. Accordingly, some fibers give the paper increased strength, while other fiber types may improve other properties, e.g. brightness, smoothness, opacity, or porosity. There are numerous fiber combinations, and also combinations of properties which are desired in paper.

Lignocellulosic materials of interest include, but are not limited to, those derived from wood, more specifically heart/core wood and/or outer wood derived from trunks or stems of coniferous trees. It will be understood by one skilled in the art that any source of lignocellulosic material could potentially be of value, including: wood from the branches or roots of trees or shrubs; non-wooden plant material in the form of stem, stalk, foliage, bark, root, shell, pod, nut, husk, fiber, vine, straw, hay, grass, bamboo or reed, singularly; algal material; or recycled paper.

Useful sources of wood may include numerous species of coniferous and broad-leaved trees/shrubs. Preferred sources of wood in the context of the invention are derived from conifers, specifically WRC (*Thuja plicata*) and Yellow Cypress (*Callitropsis nootkatensis* also known as *Chamaecyparis nootkatensis*). It will be understood by a person skilled in the art that several other sources of conifer could be of value, including Sitka Spruce.

One skilled in the art will appreciate that the original physical characteristics of lignocellulosic materials will make it desirable to comminute the material in order to obtain pieces of sufficiently small size and/or sufficiently high surface area to mass ratio to enable pulping of the material to be performed satisfactorily. In the case of wood, material of suitable dimensions will often be available as a waste product in the form of wood chips, wood flakes, sawdust, twigs and the like from sawmills, forestry and other commercial sources. Preferred dimensions will be in the form of wood chips.

As used herein, "accepts" refers to the lignocellulosic material, such as wood chips, chosen for pulping.

As used herein, basic wood chip density is obtained by dividing the oven dried (OD) weight of the wood chips by the green (swollen) volume.

A pulp mill may adjust various parameters, including lignocellulosic material, chemical, and process parameters, in an attempt to achieve maximum throughput of a select pulp grade at the lowest possible cost per unit of pulp. Accordingly, pulp mills seek to balance operating/output parameters, typically expressed as Kappa number (degree of delignification), percentage of pulp-yielding material rejects, cooking or digestion parameters (temperature, pressure, time, etc.), white liquor requirements, H-factor, etc. Improvements in any one or more of these and other variables can lead to either greater through-put in a pulp mill or a lower cost per unit of pulp.

As used herein, kappa is the degree of delignification of a cellulosic pulp. The standard method of determining kappa of pulp is described in TAPPI T236. In general, kappa number reflects a balance between pulp strength, pulp yield, and downstream processing costs including bleaching.

As used herein, "H-factor" is the integrated value of reaction rate at a given temperature over time. H-factor is calculated as:

$$\text{H-factor}=\int_0^t e^{(43.2-(16113/(T+273)))}dt$$

where temperature (T) is in ° C. and time (t) is in hours. When combined with cooking chemical concentration, H-factor is used to predict and control the degree of delignification (kappa) that occurs as the chip travels through the digester.

As used herein, "yield" refers to the ratio of cellulosic pulp output (i.e. recovered pulp) to raw material input, expressed as a percentage. "Unscreened yield" refers to yield including cellulosic shives, that is, under-cooked lignocellulosic material of dimensions which will not pass through mill pulp screening systems.

As used herein, "breaking length" values refer to the tensile force required to break or rupture a test specimen, reported in terms of the length of the sample strip that will break under its own weight (expressed in km). Finer and longer fibers are reported to exhibit higher sheet breaking length due to increased inter-fiber bonding. Accordingly, differences in breaking length may be attributed to the cumulative effects of fiber length, bonding, and strength in pulp. Breaking length is measured using Tappi standard T494.

As used herein "tear index" refers to the mean force (expressed in mN) required to continue the tearing of paper from an initial cut per basis weight (expressed in $g/m^2$) of a single one square meter sheet. Differences in tear index are due to the cumulative effects of fiber length, bonding, and strength in pulp. Tear index is measured using Tappi standard T414.

As used herein, "burst strength" refers to the resistance of paper to rupture as measured by the hydrostatic pressure required to burst it when a uniformly distributed and increasing pressure is applied to one of its sides. As used herein, "burst index" refers to the ratio of the burst strength (expressed in kilopascal) and the basis weight (expressed in $g/m^2$). Burst strength is measured using Tappi standard T403.

As used herein, the "tensile strength" is the maximum strength of randomly oriented pulp fibers when formed in a sheet. Tensile strength provides an indication of the maximum possible strength of pulp when beaten under ideal conditions. Several methods of measuring tensile strength are known in the art. "Zero span breaking strength", for example, is described in TAPPI T231. "Wet zero span tensile strength" of pulp is measured using TAPPI T273.

As used herein, "wet zero-span" testing measures the tensile strength of single fibers by testing hand sheets with a span as close to zero as possible. Using wet zero-span reduces the effect of bonds, and the resulting data can be used to describe deformation of fibers within each pulp.

Fiber length is one of the most important parameters of pulp. Pulp strength is directly proportional to fiber length and dictates its final use. Several methods of measuring fiber length of pulp are known in the art. The "fiber length of pulp by projection" is described in TAPPI T232. The "fiber length of pulp by classification" is described in TAPPI T233. "Fiber length of pulp and paper by automated optical analyzer using polarized light" is described in TAPPI T271. As used herein, the "length-weighted fiber length" is described in Tappi T271.

As used herein, "coarseness" is the weight per unit length of a cellulosic fiber. Fiber coarseness is described in TAPPI T234. Another method now commonly used relies on the measurement of the total length of a known mass of pulp fibers with an optical fiber length analyzer. Coarseness is obtained by dividing the pulp mass by the total measured length of the fibers.

As used herein, "fines" refers to the portion of fibers which are shorter than a specified length, typically less than 0.2 mm.

As used herein, "kink index" refers to the sum of the number of sharp bends within a range of kink angles divided by the total fiber length of all the fibers.

As used herein, "shape index" refers to the ratio of actual fiber length to the distance between the two fiber ends minus 1. Shape index indicates the continuous curvature of the fibers greater than 0.5 mm in length within the selected range limits.

As used herein, "rejects" refers to the material removed and discarded during the cleaning and screening of brown stock pulp. "% rejects" is the ratio of rejects to retained cellulosic pulp, expressed as a percentage.

As used herein, "viscosity" of a pulp provides an estimation of the average degree of polymerization of the cellulose fiber. Accordingly, viscosity indicates the relative degradation of cellulose fiber during the pulping and bleaching process. The standard procedure of measuring pulp viscosity is described in TAPPI T230.

Standardized reference pulp can be processed by beating in a "PFI Mill" in accordance with ISO 5264/2 and TAPPI T-248. In a PFI Mill, a measured amount of pulp at specified concentration is beaten between a roll with bars and a smooth-walled beater housing, both rotating in the same direction but at different peripheral speeds. Beating action is achieved through the differential rotational action and the application of a specified load between the beater roll and the housing for a specified number of revolutions. PFI Mill beating is a widely accepted method of simulating commercial refining practices. Physical testing of handsheets formed from this pulp helps predict the ultimate performance of pulp when converted to paper.

As used herein, "freeness" refers to the drainage time of a cellulosic pulp and is discussed in reference to market pulp and/or unrefined pulp. Freeness can provide an indication of: fiber length of pulp, as long fiber pulps have more freeness compared to short fiber pulps; fiber damage during pulping, bleaching or drying, as short fibers or fines produced during the pulping operation reduces pulp freeness; and refining energy required to achieve certain slowness during stock preparation. The standard procedure of measuring pulp freeness is described in TAPPI T221, T227, ISO 5267-1 and ISO 5267-2. Canadian Standard Freeness, for example, is described by TAPPI T227 and reported as CSF.

"Pulp density" is calculated as the ratio between grammage and the thickness of the material and is expressed in $g/cm^3$.

As used herein, "brightness" refers to the reflectance or brilliance of the pulp when measured under a specially calibrated blue light and is measured using Tappi standard T452.

As used herein, "porosity" refers to the permeability of a pulp to air. Porosity is, among other things, an important factor in ink penetration and is measured using Tappi standard T460.

As used herein, "stiffness" refers to the slope of the tangent of the tensile strength-strain curve at the point of zero strain. The tensile stiffness (in N/m of width) is equal to the elastic modulus multiplied by the paper thickness. When the tensile stiffness is divided by the grammage, it is called the tensile stiffness index (Nm/kg), which numerically equals the specific elastic modulus (in Nm/kg).

As used herein, "stretch" refers to the maximum tensile strain developed in the sample strip before rupture. The stretch or percentage elongation is expressed as a percentage and is measured using Tappi standard T404.

As used herein, "smoothness" refers to the surface uniformity of paper. Sheets that are flat and even provide better ink dot formation and sharper images and is measured using Tappi standard T538.

As used herein, "scattering coefficient" refers to the tendency of a sheet to scatter light and is measured using Tappi standard T220.

As used herein, "collapse index" refers to the fractional loss of lumen volume that results from fiber processing. The collapse index depends on the treatment and fiber morphology, including fiber dimensions and the fiber wall material. The behavior of fibers as they collapse affects how fibers conform to one another in the sheet.

As used herein, a high HWRC pulp is a cellulosic pulp comprising at least 85% cellulosic fibers from WRC and having the following physical characteristics:

a. a post-bleaching kappa between 0 and 5 b. a length-weighted fiber length between 1.8 and 2.2 mm;

c. a coarseness between of 0.06 and 0.16 mg/m;

d. a brownstock freeness of between 550 mL and 610 mL;

e. a tensile strength between 8.0 km and 9.5 km at 500 Csf; and f. a porosity between 20 Gurley second 60 Gurley sec. at 500 Csf.

Accordingly, a "HWRC-like" pulp, as used herein, is a cellulosic pulp comprising 85% or less cellulolosic fibers from WRC but otherwise having the same physical characteristics, namely:

a. a post-bleaching kappa between 0 and 5 b. a length-weighted fiber length between 1.8 and 2.2 mm;

c. a coarseness between of 0.06 and 0.16 mg/m;

d. a brownstock freeness of between 550 mL and 610 mL;

e. a tensile strength between 8.0 km and 9.5 km at 500 Csf; and f. a porosity between 20 Gurley second 60 Gurley sec. at 500 Csf.

The species composition of a cellulosic pulp may be determined, for example, by conventional microscopy using PAPTAC procedures B2 or B7, or Tappi standard T401. A HWRC-like pulp may comprise 80%, 70%, or 60% or less cellulosic fibers from WRC, and may comprise as little as 50% cellulosic fibers from WRC.

A HWRC-like pulp will comprise cellulosic fibers from a second source of lignocellulosic material. The cellulosic fibers from a second source of lignocellulosic material may comprise 20%, 30%, 40% or more of the cellulosic fibers of a HWRC-like pulp, and may comprise as much as 50% of the cellulosic fibers of a HWRC-like pulp.

A pulp comprising a mixture of cellulosic fibers from WRC and a second source of lignocellulosic material will be produced by the delignification of a blend of WRC materials and the second lignocellulosic material. HWRC-like pulps may be produced from the delignification of a blend comprising 80%, 70%, 60% or less lignocellulosic material from WRC by OD weight, and as little as 50% lignocellulosic material from WRC by OD weight. Correspondingly, the blend may comprise 20%, 30%, 40% or more of the lignocellulosic material from the second source by OD weight, and may comprise as much as 50% lignocellulosic material from the second source by OD weight.

Processes of Producing a HWRC-like Pulp Comprising 80% or Less WRC

In one aspect of the disclosed invention, a process is provided for delignifying a lignocellulosic material comprising a blend of WRC chip furnishes and a second lignocellulosic material to produce a HWRC-like pulp comprising 85% or less WRC fibres.

In one embodiment involving a batch process for delignifying lignocellulosic material comprising a blend of WRC chip furnishes and the second lignocellulosic material to produce a HWRC-like pulp comprising 80% or less WRC fibres, the lignocellulosic blend may be fed into a batch digester and held in an aqueous alkaline pulping solution under select temperature/pressure conditions for a calculated period of time, typically an H-factor of or more 1500, such as 1750, to attain desired pulp characteristics. The aqueous alkaline pulping solution may preferably include a mixture of sodium hydroxide and sodium sulfide. The cooked pulp may then be recovered into a different vessel to yield an amount of pulp suitable for further processing, such as chemical and/or heat recovery, washing, further digestive-type processing, or bleaching, prior to paper manufacturing. Desired pulp characteristics may include, for example, a kappa in the range of 15-30. Additional desired pulp characteristics may include fiber length, fiber coarseness, fiber strength, freeness, and porosity. Preferably, the pulp will have the characteristics of a HWRC-like pulp.

In another embodiment involving a continuous digestion process for delignifying lignocellulosic material comprising a blend of WRC chip furnishes and a second lignocellulosic material to produce a HWRC-like pulp, the blend is fed into an aqueous alkaline pulping solution at the feed end of a digester and controllably moved through zones of select temperature/pressure, typically an H-factor of at 1500 or greater, such as 1750, to a regulated recovering end (i.e. a valve) to continuously yield pulp having desired characteristics. The aqueous alkaline pulping solution may preferably include a mixture of sodium hydroxide and sodium sulfide. The cooked pulp may then be recovered, i.e. "blown", into a different zone to yield an amount of pulp suitable for further processing, such as chemical and/or heat recovery, washing, further digestive-type processing, bleaching, prior to paper manufacturing. Desired pulp characteristics may include, for example, a kappa in the range of 15-30. Bleaching may include oxygen delignification. Bleached pulp may then be refined in a PFI mill at 0, 3000, 6000, and 9000 revolutions, and the like. Desired pulp characteristics may include, for example, a kappa in the range of 0-5. Additional desired pulp characteristics may include fiber length, fiber coarseness, fiber strength, freeness, and porosity. Preferably, the pulp may have the characteristics of a HWRC-like pulp. Additional desired pulp characteristics may include fiber length, fiber coarseness, fiber strength, freeness, and porosity. Preferably, the pulp may have the characteristics of a HWRC-like pulp.

In one embodiment the second source of lignocellulosic material may be a Yellow Cypress chip furnish. However it will be understood by one skilled in the art that several sources of lignocellulosic material could be of value. One of skill in the art will appreciate that any source of lignocellulosic material may be used provided that its fiber properties are generally compatible with the production of a HWRC-like pulp, and the differences in the pulping rate between WRC chips and the second lignocellulosic material do not cause bleaching issues or negatively impact the fiber coarseness of the resulting pulp.

Production of a HWRC-like Pulp by a Continuous Process

In another embodiment, a continuous process is provided for the production of a HWRC-like pulp. A continuous process for delignifying lignocellulosic material comprising a WRC chip furnish and a second lignocellulosic material may include feeding the lignocellulosic blend into an aqueous alkaline pulping solution at the feed end of a continuous digester to produce a lignocellulosic mass. The second lignocellulosic material may be provided in a proportion that increases the density of the lignocellulosic mass to a density sufficient to allow the lignocellulosic mass to sink in the pulping solution. Accordingly, the mass may be controllably moved through zones of select temperature/pressure in the pulping solution, such as with an H-factor of 1500 or greater, to a regulated recovery end (i.e. a valve) to continuously yield pulp having desired characteristics. The aqueous alkaline pulping solution may include a mixture of sodium hydroxide and sodium sulfide. The cooked pulp may comprise 80% or less WRC fibres. The cooked pulp may then be recovered into a different zone to yield an amount of pulp suitable for further processing, such as chemical and/or heat recovery, washing, further digestive-type processing, bleaching, prior to paper manufacturing. Bleaching may include oxygen delignification. Bleached pulp may then be refined in a PFI mill at 0, 3000, 6000, and 9000 revolutions, and the like. Desired pulp characteristics may include, for example, a kappa in the range of 0-5. Additional desired pulp characteristics may include fiber length, fiber coarseness, fiber strength, freeness, and porosity. Preferably, the pulp may have the characteristics of a HWRC-like pulp.

In a preferred embodiment the second source of lignocellulosic material may be a Yellow Cypress chip furnish. However it will be understood by one skilled in the art that several sources of lignocellulosic material could be of value. One of skill in the art will appreciate that any source of lignocellulosic material may be used provided that its fiber properties are generally compatible with the production of a HWRC-like pulp, and the differences in the pulping rate between WRC chips and the second lignocellulosic material do not cause bleaching issues or negatively impact the fiber coarseness of the resulting pulp.

Cellulosic Pulps

In another embodiment, the invention provides cellulosic pulps prepared according to the aforementioned processes. The pulps may comprise less than 80% WRC fibres.

Uses of Blends of Lignocellulosic Materials

In other embodiment, the invention provides a use for blends of lignocellulosic materials from WRC and a second source of lignocellulosic material for the aforementioned processes for the production of a HWRC-like pulp.

Methods

Chip Sources

For batch process cooks, WRC chip samples were obtained from Mill and Timber Sawmills in Surrey, British Columbia. Yellow Cypress and Sitka Spruce chip samples were obtained from S&R Sawmills in North Surrey, British Columbia. For continuous process cooks, WRC and Yellow Cypress chip samples were obtained from Delta Cedar Products in Delta, British Columbia.

Chip Drying

Chips were dried to a constant moisture content for four days.

Chip Analysis

Dry chips were analyzed for size distribution using a chip classifier. The accepts, which are those chips passing a 16 mm round hole screen but retained on a 7 mm round hole screen, were used for the pulping.

Bulk Density was determined by dividing the oven-dried weight of the chips by the volume it occupies (i.e. 10 L).

Batch Cooking

A 28-liter Weverk laboratory digester was used for each cook. Varying percent mixtures of Yellow Cypress, WRC, and Sitka Spruce chip furnishes were pulped along with pure samples of each species. The effective alkali and sulphidity of the kraft pulping liquor were 17.5% and 23.88%, respectively, and the liquor to wood ratio was 4.5:1.

Bleaching

A five stage bleaching process was followed as in Table 1. Based on Kappa values for each pulp after the oxygen delignification stage, the chlorine dioxide concentration for the D100 stage was determined. All stages that required oxygen were done in a Parr Reactor Model: No. 4551.

TABLE 1

Bleaching Conditions for WRC, Yellow Cypress, and 50/50 WRC/Yellow Cypress Mix

| BLEACHING STAGE | WRC | Yellow Cypress | 50/50 Mix |
|---|---|---|---|
| O2 Delignification | | | |
| NaOH | 4.80% | 4.80% | 4.80% |
| Oxygen | 4.80% | 4.80% | 4.80% |
| $MgSO_4$ | 0.17% | 0.17% | 0.17% |
| Consistency [%] | 8.5% | 8.5% | 8.5% |
| Temperature [° C.] | 87/92 | 87/92 | 87/92 |
| Time [minutes] | 20/20 | 20/20 | 20/20 |
| pressure (kPaG) | 625/400 | 625/400 | 625/400 |
| POW kappa | 15.4 | 16.9 | 15.3 |
| D100 | | | |
| $ClO_2$ as Kappa Factor | 0.245 | 0.245 | 0.245 |
| $ClO_2$ in % charge as $Cl_2$ | 3.77% | 4.15% | 3.74% |
| Consistency [%] | 3.5% | 3.5% | 3.5% |
| PH after $ClO_2$ | 2.8 | 2.8 | 2.8 |
| End Process pH | 2.7 | 2.7 | 2.7 |
| Temperature [° C.] | 53 | 53 | 53 |
| Time [minutes] | 25 | 25 | 25 |
| Residual $ClO_2$ (% of Initial) | 0 | 0 | 0 |
| $E_{OP}$ | | | |
| PH after 7 min | 11.2 | 11.2 | 11.2 |
| End Process pH | 10.2 | 10.2 | 10.2 |
| $H_2O_2$ | 0.25% | 0.25% | 0.25% |
| NaOH | 1.68% | 1.68% | 1.68% |
| $MgSO_4$ | 0.00% | 0.00% | 0.00% |
| $O_2$ % appl | 0.5 | 0.5 | 0.5 |
| Consistency [%] | 11 | 11 | 11 |
| Temperature [° C.] | 90 | 90 | 90 |
| Time [minutes] | 35 | 35 | 35 |
| D1 | | | |
| $ClO_2$% applied | 0.96% | 0.96% | 0.96% |
| NaOH in feed | 0.033% | 0.033% | 0.033% |
| Consistency [%] | 0.11 | 0.11 | 0.11 |
| Temperature [° C.] | 72 | 72 | 72 |
| time (min) | 142 | 142 | 142 |
| NaOH in neutralization | 1.130% | 1.130% | 1.130% |
| time (min) | 3 | 3 | 3 |
| D2 | | | |
| $ClO_2$% applied | 0.23% | 0.23% | 0.23% |
| NaOH in feed | 0.004% | 0.004% | 0.004% |
| Consistency [%] | 11 | 11 | 11 |
| Temperature [° C.] | 72 | 72 | 72 |
| time (min) | 472 | 472 | 472 |

Continuous Cooks

A 50/50 Mix of WRC/Yellow Cypress was processed in an Ahlstrom Kamyr Modified Continuous Cook (MCC) digester and a two stage medium consistency oxygen delignification system at Howe Sound Pulp and Paper ("HSPP"). The resulting pulp is herein referred to as "HS480". Tables 2, 3, 4, and 5 indicate the digester, $O_2$ delignification, and bleaching conditions under which HS480 was produced.

PFI Refining and Physical Property Testing of Bleached Pulp

Bleached pulp was refined in a PFI Mill at 0, 3000, 6000, and 9000 revolutions. Ten handsheets were made for each sample.

Physical Property Testing of Bleached Pulp

Five handsheets per refined PFI revolution point were tested for their physical and optical properties as per standard TAPPI methods. Unrefined fiber properties were analyzed using a L&W Fiber Tester (Lorentzen & Wettre, Sweden).

TABLE 2

Mill conditions HSPP during trial HS480 production.

| | | | | |
|---|---|---|---|---|
| Production rate for period 27 Jan. 2009 17:00 29 Jan. 2009 13:00 | | 1030.0 | | Bleached ADt/d Start of trial End of trial |
| Furnish: | 50.7% | Cypress | 49.3% | Cedar |
| Digester | | | | |
| Total white liquor | | 16.14 | | % EA on BD wood |
| Average H-Factor | | 1589 | | HF |
| Average blow kappa | | 26.9 | | kappa |
| $O_2$ delignification | | | | |
| $O_2$ delig oxygen | | 25.19 | | kg/ADt |
| $O_2$ delig caustic + OWL | | 28.55 | | kg/ADt |
| Magnesium sulphate | | 1.93 | | kg/ADt |
| Average POW kappa | | 16.2 | | kappa |
| Bleaching | | | | |
| Do stage $ClO_2$ | | 18.22 | | kg/ADt |
| Eop stage NaOH | | 21.78 | | kg/ADt |
| Average Eop kappa | | 2.94 | | kappa |
| $D_1$ stage $ClO_2$ | | 11.00 | | kg/ADt |
| D1 stage upflow NaOH | | 0.32 | | kg/ADt |
| D1 stage dilution zone NaOH | | 13.11 | | kg/ADt |
| $D_2$ stage $ClO_2$ | | 2.68 | | kg/ADt |
| D2 stage NaOH | | 0.09 | | kg/ADt |
| Final brightness off pulp machine | | 88.9 | | % ISO |

Confocal Microscopy

Fibers were dyed with Acridin Orange dye, deposited on cover slips, dried, and mounted on glass slides. A Bio-Rad MRC-600 microscope attached to a Nikon Optiphot microscope equipped with a 60× objective lens was used to generate pulp fiber cross-sectional images. The prepared sample slides were scanned in such a way as to ensure random sampling of fibers. Each encountered fiber was oriented perpendicular to the laser scanning direction. Cross-sectional images were then constructed from a series of horizontal line scans acquired from stepping the sample stage vertically in the z-direction through the thickness of the fiber in 0.2 μm increments. Image analysis was applied to the confocal images to define outer and inner boundaries from which the fiber transverse dimension data identified in FIG. 1 is derived.

TABLE 3

Digester operating standards for downflow cooking at HSPP during trial HS480 production.

| VARIABLE | | | MIN < | TARGET < | MAX |
|---|---|---|---|---|---|
| WL | Total WL charge | % EAW | 15.0< | | <17.0 |
| | WL to HPF | L/s | | 5 | |
| | WL to feed system | % EAW | 11.0< | | <13.0 |
| | WL to bottom circ. | % EAW | 0.5< | | <1.0 |
| | WL to MC circ. | % EAW | 3.5< | | <4.0 |
| | WL to wash circ. | % EAW | | off | |
| | WL strength test | g/L EA | 75< | | |
| | WL clarity test | ppm | | | <400 |
| | BC residual test | g/L EA | | >12 | |

TABLE 3-continued

Digester operating standards for downflow cooking at HSPP during trial HS480 production.

| | VARIABLE | | MIN < | TARGET < | MAX |
|---|---|---|---|---|---|
| | Upper extr. res. | g/L EA | 6< | | <8 |
| | Lower extr. res. | g/L EA | 7< | | <9 |
| | Wash extr. res. | g/L EA | 4< | | <7 |
| Temp | Chip bin top | Deg C. | | 85 | |
| | BC temp SP | Deg C. | 154< | | <157 |
| | MC temp SP | Deg C. | 158< | | <164 |
| | Blow line | Deg C. | | 85 | |
| | Bl. liq. cooler | Deg C. | | 85 | |
| Flow | SV relief | t/hr/RPM | | 0.45 | |
| | Chip Chute Pump Outlet | | | 17-18 threads | |
| | Bottom circulation | L/s | 180< | | <220 |
| | Trim circ. | L/s | | off | |
| | MC zone dilution factor | | | −4.0 to −3.0 | |
| | Dilution zone upflow | L/s | | +15 | |
| | CB to pipe | L/s/ADt/d | | 0.015 | |
| | MC circulation | L/s/ADt/d | | 0.060 | |
| | Jump flow | L/s/ADt/d | | 0 | |
| | Main extraction | L/s/RPM | 6< | | <9.5 |
| | Wash extraction | L/s/ADt/d | 0.05< | | <0.06 |
| | Bl. liq. filter rej. | L/s | 5< | | <8 |
| | Diffuser dil. factor | DF | 2< | | <3.5 |
| Pres | Steaming vessel | kPaG | | 135 | |
| | H.P. feeder speed | ratio | | keep low | |
| | No 1 flash tank | kPaG | | 165 | |
| | No 2 flash tank | kPaG | | 48 or 40 | |
| | Blow line | kappa | | 34.0 | |

EA = effective alkali
% EAW = % effective alkali on wood. .
t/hr = tones per hour
L/s/ADt/d = litres per second/air dried tonne/day
% BD = % bone dry

TABLE 4

$O_2$ delignification operating standards at HSPP during trial HS480 production.

| VARIABLE | | MIN < | TARGET < | MAX |
|---|---|---|---|---|
| Feed consistency | % BD | | 8.5 | |
| First reactor Temp. | Deg C. | | 87 | |
| Reactor #1 pres. | kPaG | | 600 | |
| Reactor #2 pres. | kPaG | 200< | | |
| Post O2 diffuser wash | l/s | | | |
| Mix tank dilution | l/s | 250< | | <300 |
| POW vat dilution | % | 80< | | <100 |
| 260t conductivity target | uS | 5000< | | <8000 |
| Temp to 260 t storage | deg C. | 60< | | |
| Talc addition rate | kg/ADt | | 3.0 | |
| Talc primary dilution | l/m | | 15.0 | |
| Talc flowrate | l/s | | 1.0 | |
| POW Kappa, all grades | | | 16.0 | |
| MgSO4: all grades: | % appl | | 0.17 | |
| OWL recirc flow | l/s | 6.0> | | |
| Phase separator pres. | kPaG | | 600 | |
| Phase separator temp. | deg C. | | 140 | |
| Temp. from coolers | deg C. | | 90 | |

Fiber Composition Analysis

Fiber composition of pulps was determined according to PAPTAC standards B.2 and B.7 standards. Briefly, a sub-sample of the pulp provided was dispersed and a slurry of approximately 0.05% consistency was made. Aliqouts of this slurry were deposited on glass slides and gently heated to dryness. Slides were stained with Graff C stain, coverslipped, and examined with a Nikon compound microscope. Fibers were identified primarily on the basis of morphology of the cross-field pitting areas of earlywood fibres. Weight factors were taken from The Practical Identification of Wood Pulp Fibers, Parham and Gray, Tappi Press, 1990.

TABLE 5

Bleach operating standards at HSPP during trial HS480 production.

| | VARIABLE | | MIN < | target < | MAX |
|---|---|---|---|---|---|
| DC | B.S. consistency | % BD | | 3.5 | |
| | Vat pH test | pH | | 2.6 | |
| | DC tower inlet pH | pH | 2.6< | | <2.9 |
| | Kappa factor | KF | 0.18< | | <0.26 |
| | Vat residual test | g/L | 0< | | <0.02 |
| | Bottom showers | % split | Dca = 75 | | Dcb = 60 |
| | Top showers | DF | 0.6< | | <1.0 |
| Eop | Steam mixer temp | deg C. | | 92.0 | |
| | Peroxide application | % | | 0.25 | |
| | Oxygen application | % | | 0.5 | |
| | MgSO4 application | % | | 0.0 | |
| | Tower level | % | | 75 | |
| | Tower exit pH | pH | | 10.2 | |
| | Bottom showers | % split | | 75 | |
| | Top shower bar | DF | 0.6< | | <1.0 |
| Dn | Upflow temp | deg C. | 71.0< | | <75.0 |
| | Upflow res sample | g/L | 0.20< | | <0.40 |
| | Upflow pH sample | pH | | 4.2 | |
| | Vat pH | | | 8.5 | |
| | Tower level | % | | 75 | |
| | Bottom showers | % split | | 75 | |
| | Top shower bar | DF | 0.6< | | <1.0 |
| | Repulper sheet brt | % ISO | 85.0< | | <87.0 |
| D2 | Upflow temp | deg C. | 71.0< | | <75.0 |
| | Upflow res sample | g/L | 0.10< | | <0.40 |
| | Upflow pH sample | pH | | 4.2 | |
| | Tower level | % | | 75 | |
| | All showers | DF | 0.6< | | <1.0 |
| | Repulper sheet brt | % ISO | 90.0< | | <90.5 |
| | Bleach HW Temp | deg C. | | 70 | |
| | Blue Scrubber Liquor | pH | | 10.0 | |
| | Machine brightness | % ISO | 89.0< | | |
| | Machine dirt | specks/kg | | | <15.0 |
| | Machine shives | number | | | <5.0 |
| | Machine viscosity | CP | 14.0< | | |

EXAMPLES

Example 1

Small Batch Cooks

Chip Classification

Figure 2:
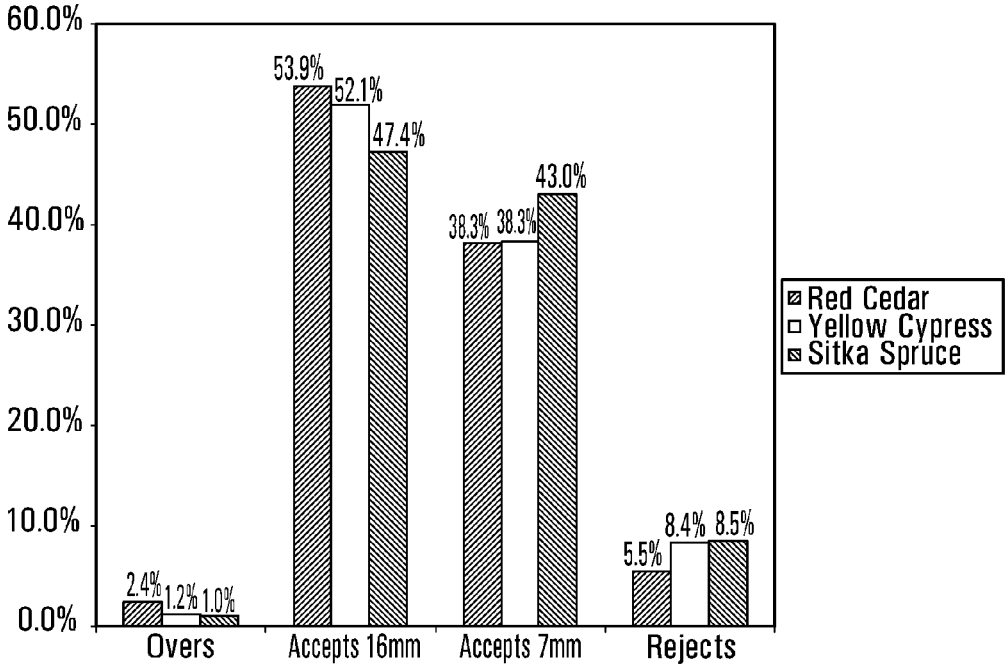
FIG. 2 is a histogram showing chip size distribution of chips from WRC, Yellow Cypress, and Sitka Spruce.
Figure 3:
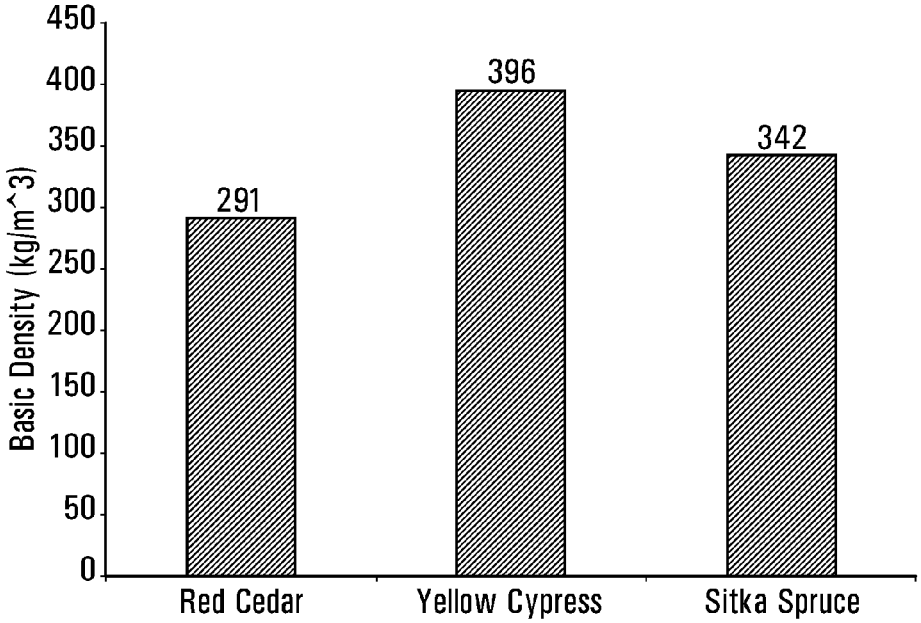
FIG. 3 is a histogram showing the basic density of WRC, Yellow Cypress, and Sitka Spruce chips.

WRC chips had the highest 16 mm accepts and the lowest rejects compared to the Yellow Cypress chips and Sitka Spruce chips (FIG. 2). Sitka Spruce had the highest 7 mm accept chips. Yellow Cypress has the highest basic and bulk densities (FIGS. 3 and 4).

Figure 4:
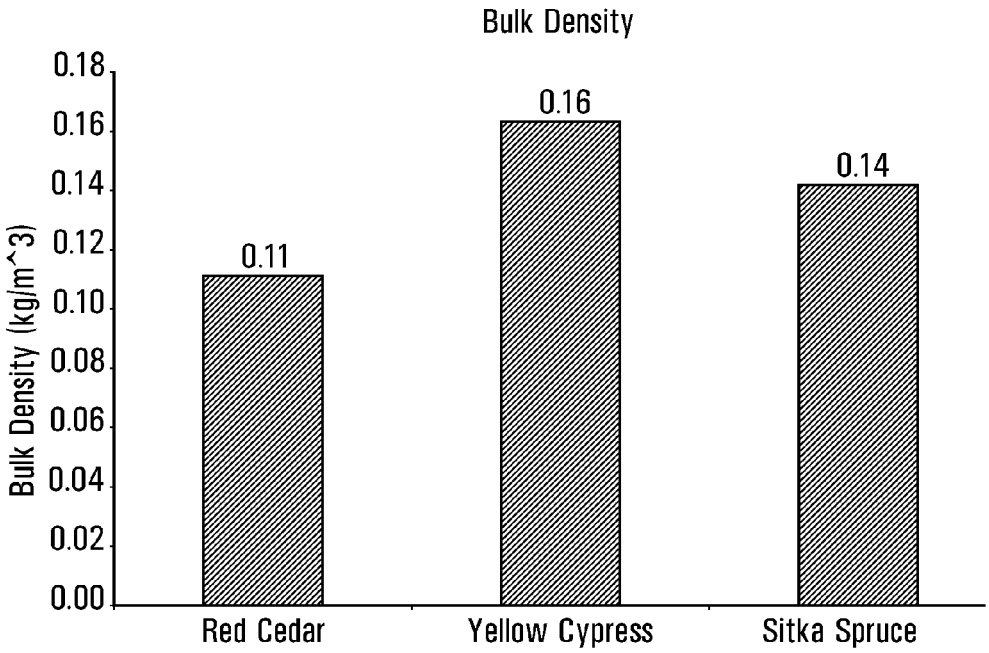
FIG. 4 is a histogram showing the bulk density of WRC, Yellow Cypress, and Sitka Spruce.

FIG. 4 shows that WRC has the lowest bulk density, occupying ~26.5% less volume in a 10 L container when compared to Yellow Cypress.

Kraft Pulping of Sitka Spruce, WRC and Yellow Cypress Blends

Varying percent mixtures of Yellow Cypress, WRC, and Sitka Spruce chips were pulped along with pure samples of each species in a 28 L Weverk laboratory batch digester. Each cook required four 750 g OD chips per basket. A total of 12 blends were pulped, and the resulting data is outlined in Table 6. The initial cooked blends of WRC/Yellow Cypress and WRC/Sitka spruce underwent fiber analysis, PFI refining, and testing for physical properties.

Table 6 shows the cooking data for the blends. The 100% Yellow Cypress sample resulted in the highest yield. All blends with higher Yellow Cypress contents resulted in higher yields when compared to the Sitka Spruce blends.

Figure 5:
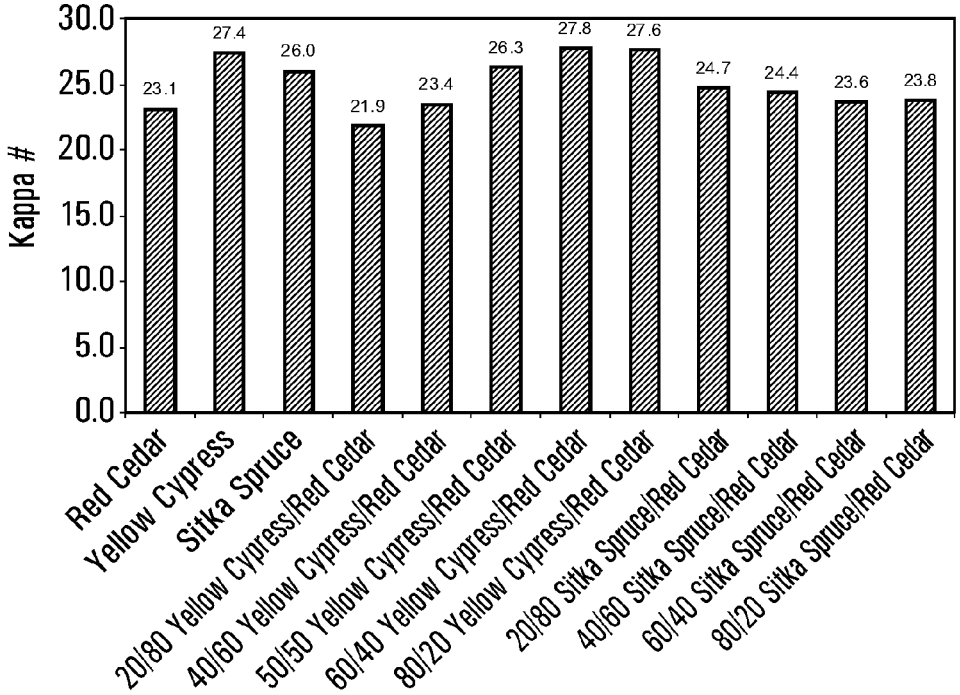
FIG. 5 is a histogram showing the kappa values of the pulps resulting from small cooks of WRC, Yellow Cypress, Sitka Spruce, WRC/Yellow Cypress blends, and WRC/Sitka Spruce blends.
Figure 6:
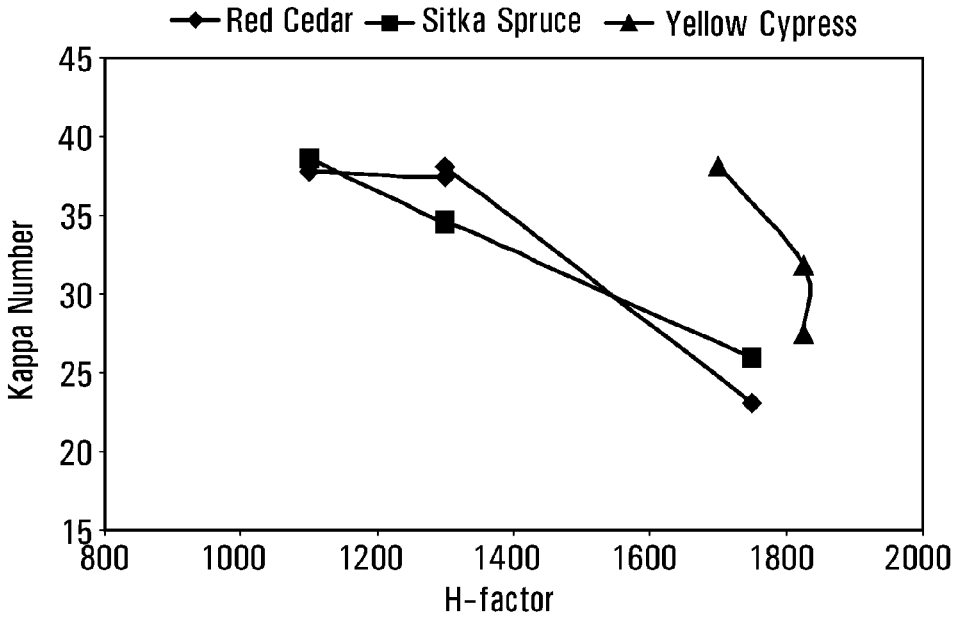
FIG. 6 shows the kappa values as a function of H-factor for WRC, Yellow Cypress, and Sitka Spruce.

Yellow Cypress chips required additional cooking time than WRC chips and Sitka Spruce chips (FIG. 5), and the shape of the curves indicated that additional optimization in terms of chemical charge and cooking temperature might be required in order to ensure acceptable production rates and bleaching efficiency of Yellow Cypress. Samples containing higher percentages of Yellow Cypress chips were generally harder to cook and required additional cooking time to achieve comparable kappa than samples containing higher percentages of WRC or Sitka Spruce (Table 6, FIG. 6). These preliminary results suggested that Yellow Cypress would not cook well together with WRC to produce a HWRC-like pulp.

Figure 7:
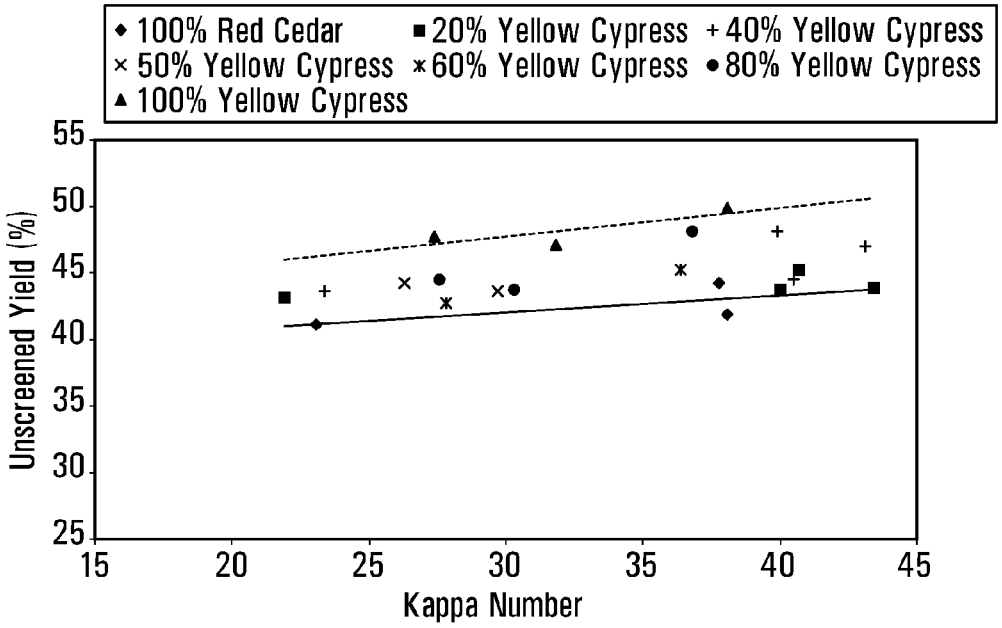
FIG. 7 shows the unscreened yield as a function of kappa for WRC, Yellow Cypress, and WRC/Yellow Cypress blends.
Figure 8:
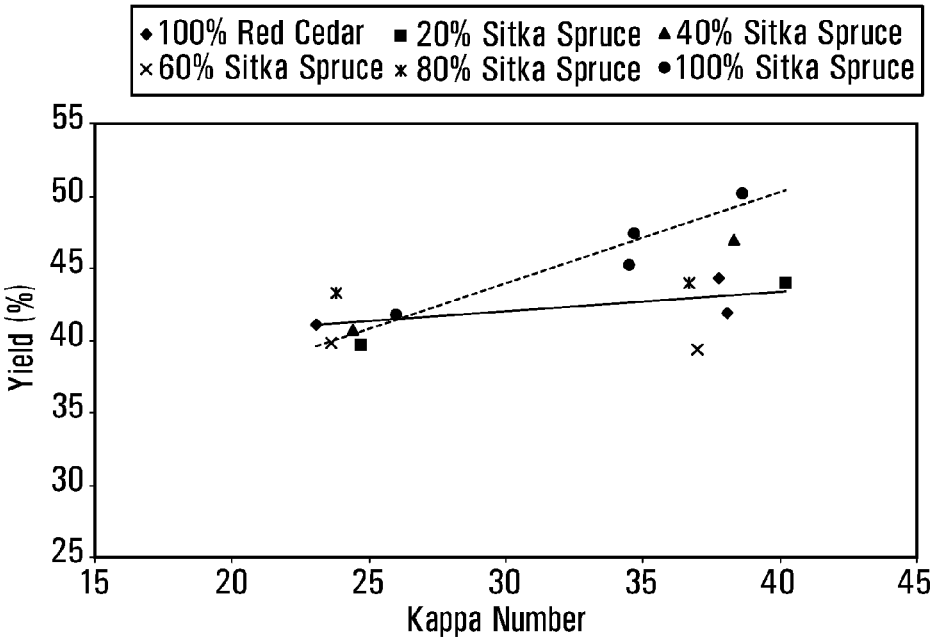
FIG. 8 shows the unscreened yield as a function of kappa for WRC, Sitka Spruce, and WRC/Sitka Spruce blends.

Nevertheless, blends with higher Yellow Cypress or 100% Yellow Cypress resulted in ~4% higher unscreened yield values than WRC at any given kappa number (FIG. 7). The unscreened yield of Sitka spruce is similar to that of WRC at the kappa number 25-30 range (FIG. 8). This observation, in addition to the low basic and bulk density of Sitka Spruce, suggests that Sitka Spruce would be an inferior candidate to Yellow Cypress for mixing with WRC.

Figure 9:
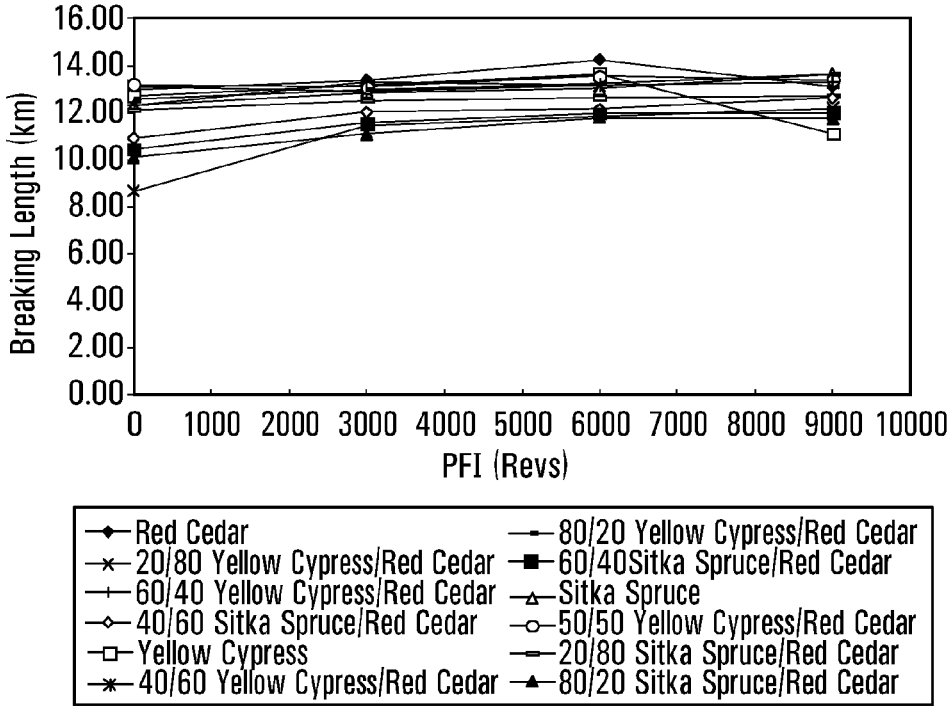
FIG. 9 shows the breaking length as a function of PFI for WRC, Yellow Cypress, Sitka Spruce, WRC/Yellow Cypress blends, and WRC/Sitka Spruce blends.
Figure 10:
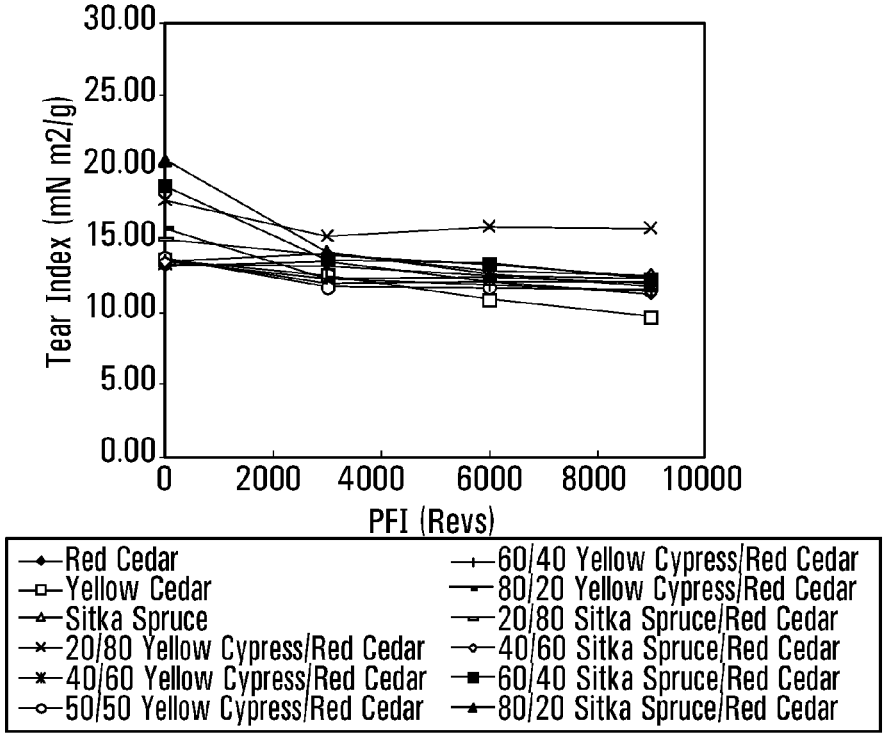
FIG. 10 shows the tear index as a function of PFI for WRC, Yellow Cypress, Sitka Spruce, WRC/Yellow Cypress blends, and WRC/Sitka Spruce blends.
Figure 11:
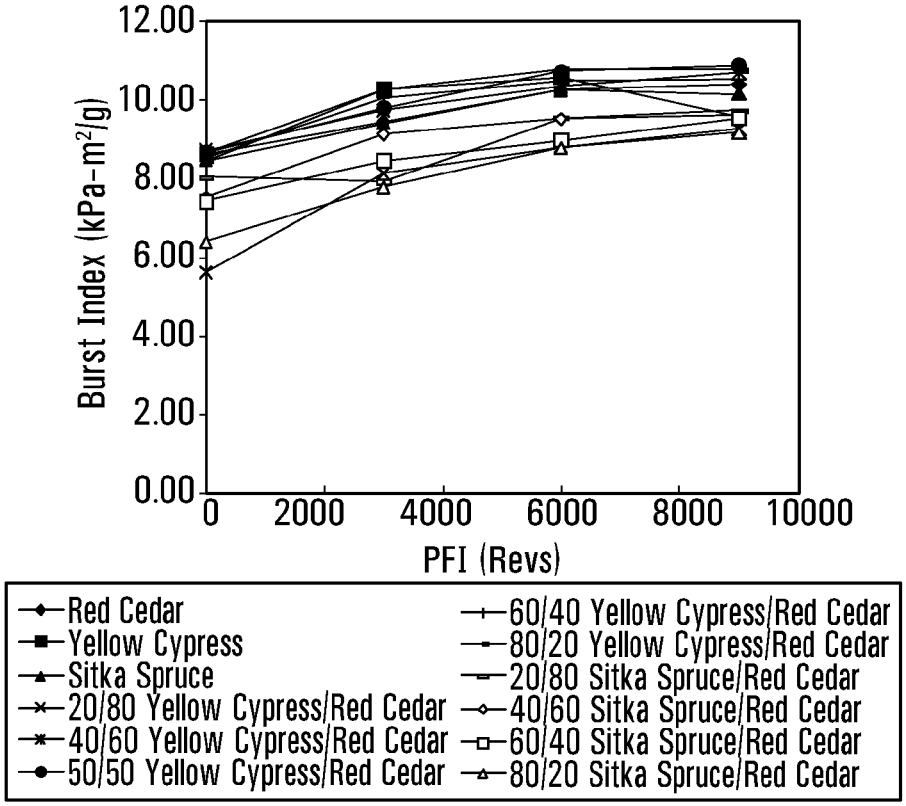
FIG. 11 shows burst index as a function of PFI for WRC, Yellow Cypress, Sitka Spruce, WRC/Yellow Cypress blends, and WRC/Sitka Spruce blends.
Figure 12:
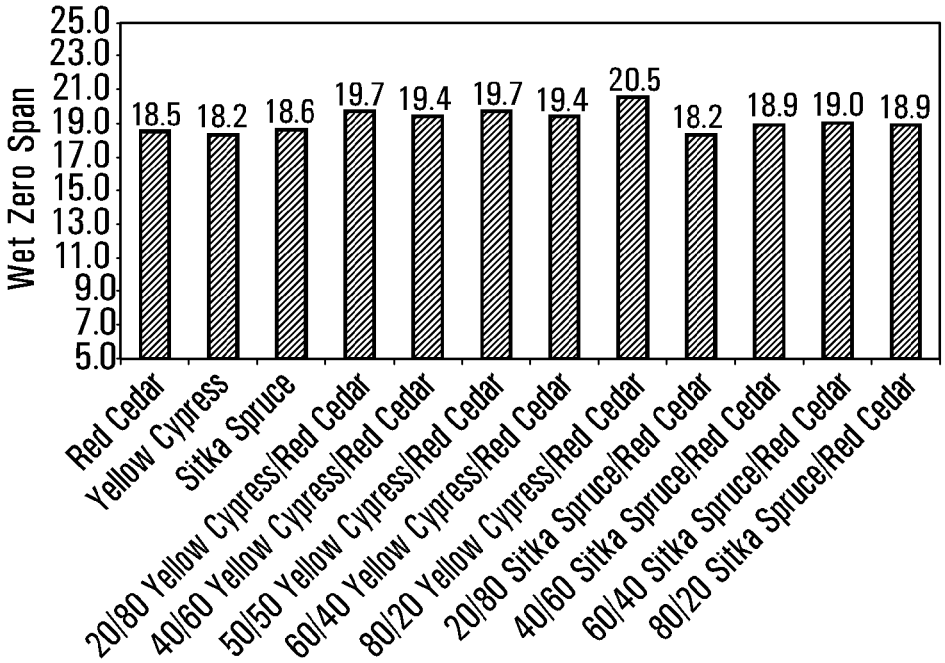
FIG. 12 is a histogram showing the Wet Zero Span of WRC, Yellow Cypress, Sitka Spruce, WRC/Yellow Cypress blends, and WRC/Sitka Spruce blends.
Figure 13:
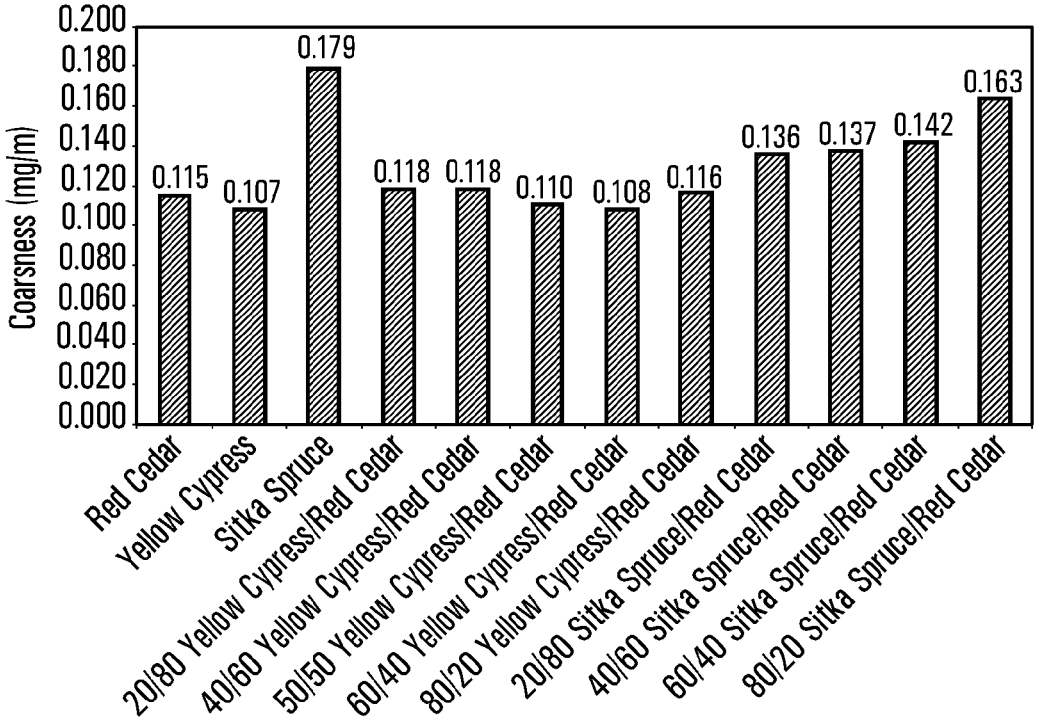
FIG. 13 is a histogram showing the L&W Fibre Tester fiber coarseness of WRC, Yellow Cypress, Sitka Spruce, WRC/Yellow Cypress blends, and WRC/Sitka Spruce blends.
Figure 14:
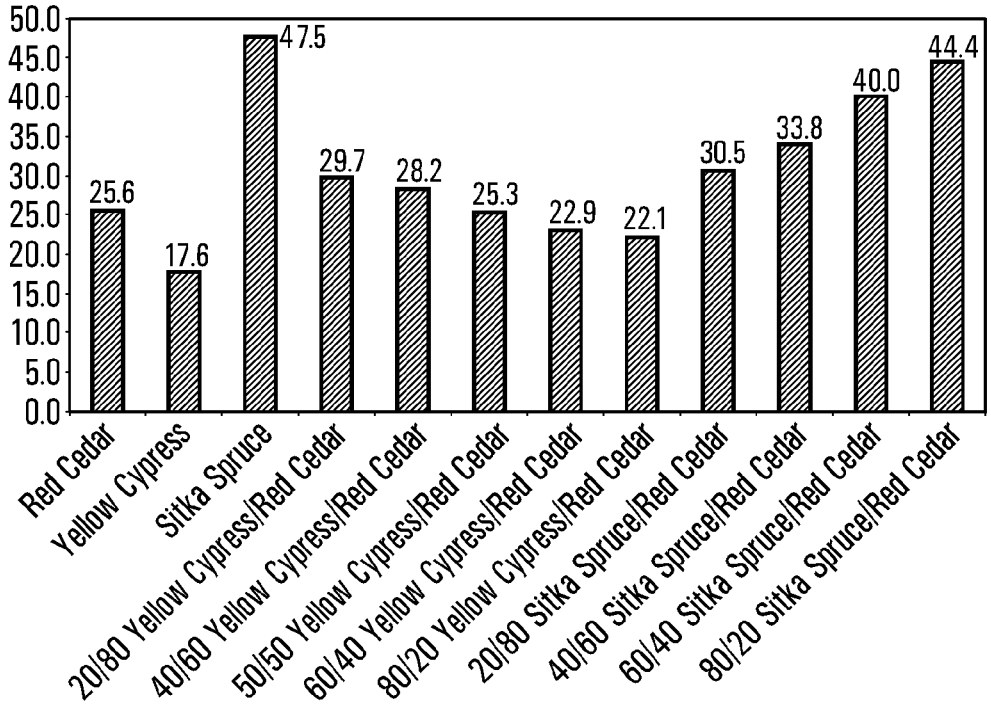
FIG. 14 is a histogram showing the L&W Fibre Tester % fines for WRC, Yellow Cypress, Sitka Spruce, WRC/Yellow Cypress blends, and WRC/Sitka Spruce blends.
Figure 15:
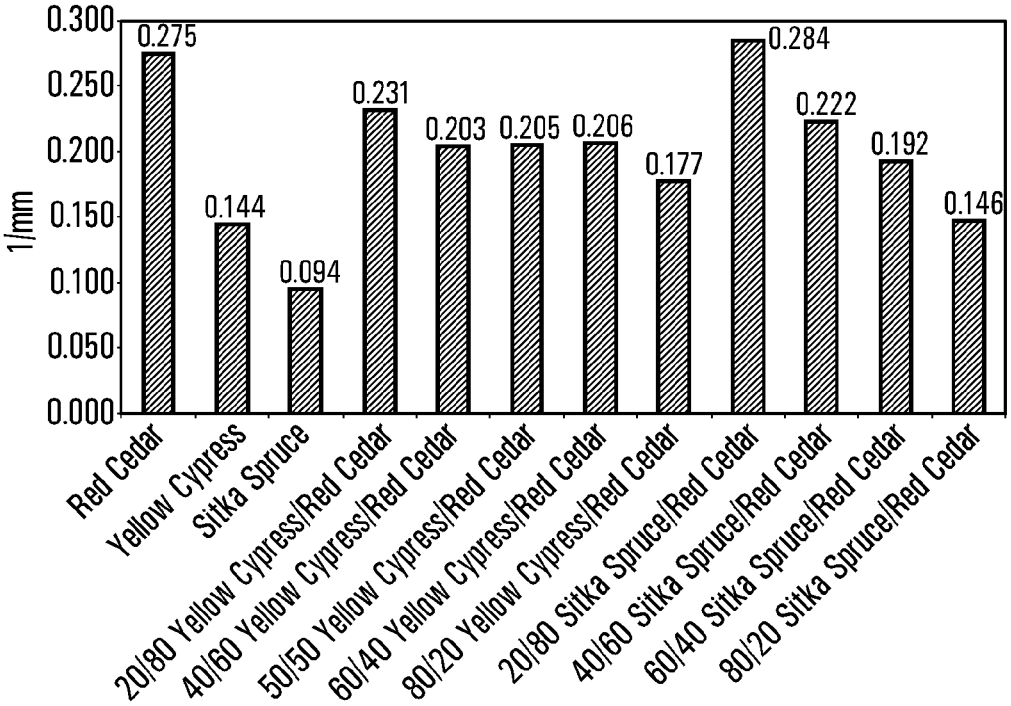
FIG. 15 is a histogram showing the L&W Fibre Tester kink index for WRC, Yellow Cypress, Sitka Spruce, WRC/Yellow Cypress blends, and WRC/Sitka Spruce blends.
Figure 16:
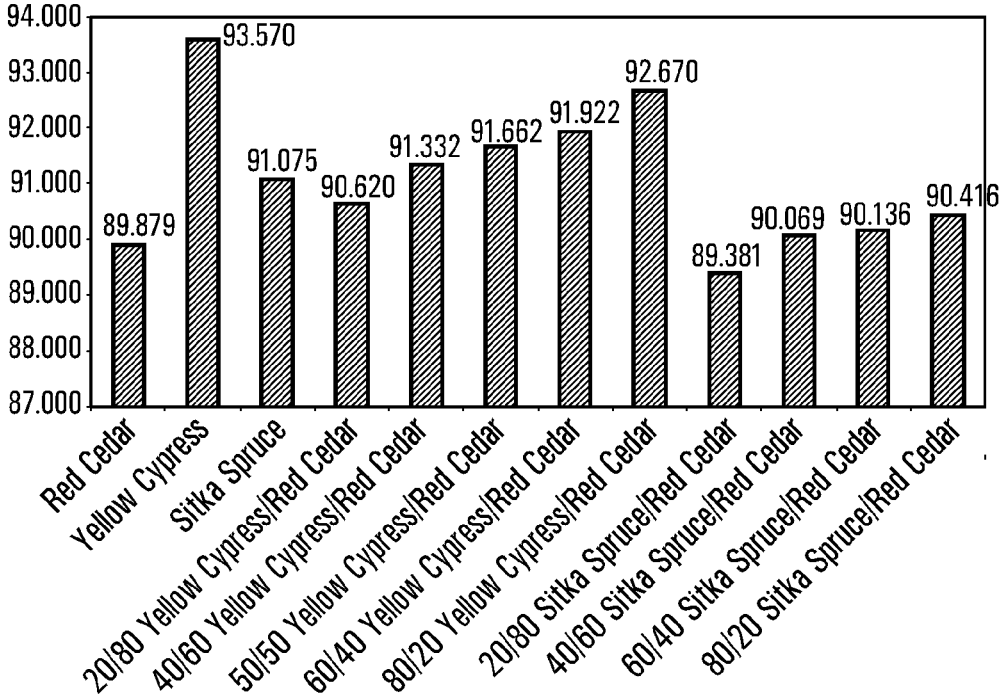
FIG. 16 is a histogram showing the L&W Fibre Tester shape index for WRC, Yellow Cypress, Sitka Spruce, WRC/Yellow Cypress blends, and WRC/Sitka Spruce blends.

FIGS. 9 to 16 depict the fiber properties of the various WRC, Yello Cypress, ans Sitka Spruce blends. The control and blends containing Sitka Spruce, for example, exhibited inferior breaking length by >1.5 km compared to WRC and Yellow Cypress-containing pulps (FIG. 9). Yellow Cypress-containing pulps maintained superior fiber strength despite requiring additional cooking.

TABLE 6

Summary of Resulting Data from Small Cooks

| Chip Blends Cooked | H-Factor | OD wt of Pulp | % Yield Unscreened | % Rejects | Weight of Screened Pulp | % Yield Screened Pulp | Kappa |
|---|---|---|---|---|---|---|---|
| Red Cedar | 1750 | 308.1 | 41.10% | 0.70% | 305.87 | 40.80% | 23.1 |
| Sitka Spruce | 1750 | 313.6 | 41.80% | 1.20% | 309.79 | 41.30% | 26 |
| Yellow Cypress | 1825 | 358.8 | 47.80% | 1.10% | 354.88 | 47.30% | 27.4 |
| 20/80 Sitka Spruce/Red Cedar | 1750 | 297.5 | 39.70% | 1.00% | 294.6 | 39.30% | 24.7 |
| 40/60 Sitka Spruce/Red Cedar | 1750 | 306.3 | 40.80% | 0.50% | 304.68 | 40.60% | 24.4 |
| 60/40Sitka Spruce/Red Cedar | 1750 | 298.5 | 39.80% | 0.90% | 295.89 | 39.50% | 23.6 |
| 80/20 Sitka Spruce/Red Cedar | 1750 | 325 | 43.30% | 0.80% | 322.38 | 43.00% | 23.8 |
| 20/80 Yellow/Red Cedar | 1750 | 322.9 | 43.10% | 1.30% | 318.77 | 42.50% | 21.9 |
| 40/60Yellow/Red Cedar | 1750 | 327 | 43.60% | 1.50% | 322.15 | 43.00% | 23.4 |
| 50/50Yellow/Red Cedar | 1825 | 331.7 | 44.20% | 1.10% | 328.02 | 43.70% | 26.3 |
| 60/40Yellow/Red Cedar | 1825 | 320.6 | 42.70% | 1.40% | 316.27 | 42.20% | 27.8 |
| 80/20Yellow/Red Cedar | 1825 | 333.9 | 44.50% | 1.50% | 328.88 | 43.90% | 27.6 |

Example 2

Large Batch Cooks for Bleaching

Part 1. Cooking

A 28 L Weverk laboratory digester was used for three large cooks consisting of a 50/50 Mix of WRC and Yellow Cypress (the "50/50 Mix"), 100% WRC, and 100% Yellow Cypress. Each cook required 3000 g OD weight of chip furnishes. 90 minutes was given to reach the maximum temperature of 170° C.

TABLE 7

Cooking Results from Large Cooks

| Sample | H-Factor | OD wt of Pulp | % Yield Unscreened | % Rejects | Weight of Screened Pulp | % Yield Screened Pulp | Kappa |
|---|---|---|---|---|---|---|---|
| WRC | 1750 | 1210.6 | 40.4% | 1.6% | 1191.51 | 39.7% | 27.1 |
| Yellow Cypress | 1825 | 1375.8 | 45.9% | 2.3% | 1343.66 | 44.8% | 30.0 |
| 50/50 Mix | 1778 | 1242.7 | 41.4% | 2.5% | 1211.74 | 40.4% | 28.1 |

Table 7 shows the cooking data for the three large cooks, which were cooked at different H-Factors since Yellow Cypress is harder to pulp and thus requires more time for pulping. WRC reached the targeted 27.0 kappa, while Yellow Cypress was 3 kappa points higher. Thus, WRC experiences a higher extent of delignification when compared to Yellow Cypress. The 50/50 Mix had a kappa closer of 28.1.

WRC showed the lowest yield. Yellow Cypress had the highest percent screened yield, with 5.5 and 5.1 percent higher unscreened and screened yield than WRC. The 50/50 Mix provided a very similar yield to WRC.

The percent rejects for Yellow Cypress were 0.7% percent higher than WRC. The 50/50 Mix had the highest percent rejects.

Part 2. Bleaching Process and Refining

Table 8 shows that Yellow Cypress experienced the highest kappa reduction after the $O_2$ delignification stage ("$O_2$ delignification") while WRC experienced the least kappa reduction. The 50/50 Mix had a kappa reduced by 1.1 more than WRC.

TABLE 8

Kappa Post Cook and $O_2$ Delignification Comparison

| Sample | Post Cook Kappa | Post $O_2$ Delignification | Resulting Kappa Reduction |
|---|---|---|---|
| WRC | 27.1 | 15.4 | 11.7 |
| Yellow Cypress | 30.0 | 16.9 | 13.1 |
| 50/50 Mix | 28.1 | 15.3 | 12.8 |

Table 9 tabulates the residual chemicals for the D100, D1, and D2 stage. There were no significant differences between WRC, Yellow Cypress, and the 50/50 Mix in the pH and $ClO_2$ residuals found in each stage.

TABLE 9

D100, D1, and D2 pH and Residual Results

| Bleaching Stage | | Red Cedar | Yellow Cypress | 50/50 Red/Yellow |
|---|---|---|---|---|
| D100 Stage | % Residual $ClO_2$ | 0.1 | 0.0 | 0.1 |
| | Final pH | 2.56 | 2.57 | 2.59 |
| D1 Stage | % Residual $ClO_2$ | 0.4 | 0.4 | 0.4 |
| | Final pH | 12.13 | 12.17 | 12.17 |
| D2 Stage | % Residual $ClO_2$ | 1.0 | 0.8 | 0.8 |
| | Final pH | 9.25 | 9.52 | 9.28 |

Part 3. Physical Testing

FIGS. 9 to 27 depict the pulp properties of the WRC, Yellow Cypress, and 50/50 Mix.

Fiber Length and Shape

Table 10 shows the fiber property data for the unrefined pulps. All analysis was done on 0 kw energy refined pulp. The results show similar fiber length and coarseness for the laboratory pulps, although the 50/50 Mix had the highest fiber length and the lowest coarseness.

Figure 17:
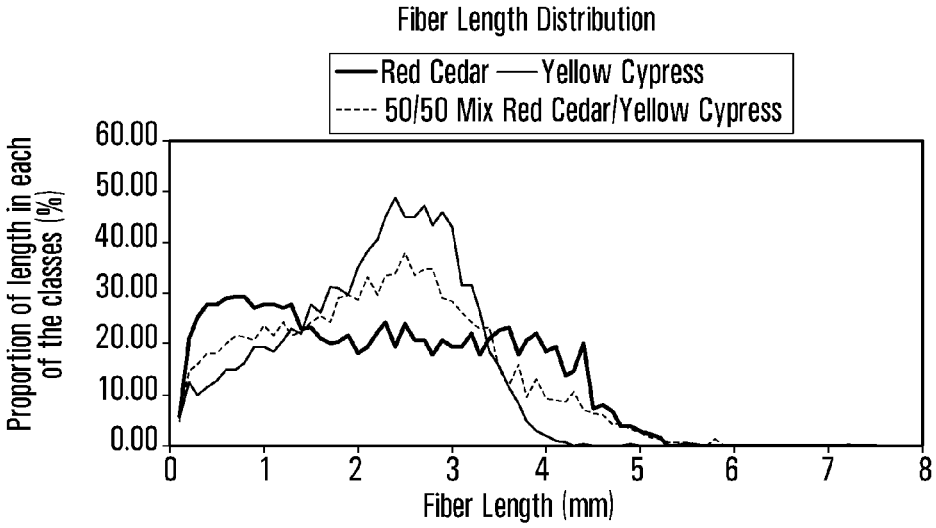
FIG. 17 shows the L&W Fibre Tester fiber length distribution of WRC, Yellow Cypress, and the 50/50 WRC/Yellow Cypress pulps.

The fiber length distribution shows that WRC had the longest fibers, with lengths between 3.5 to 5.5 mm, while Yellow Cypress had the most fibers within the 1.5 and 3.5 mm range (FIG. 17).

Figure 18:
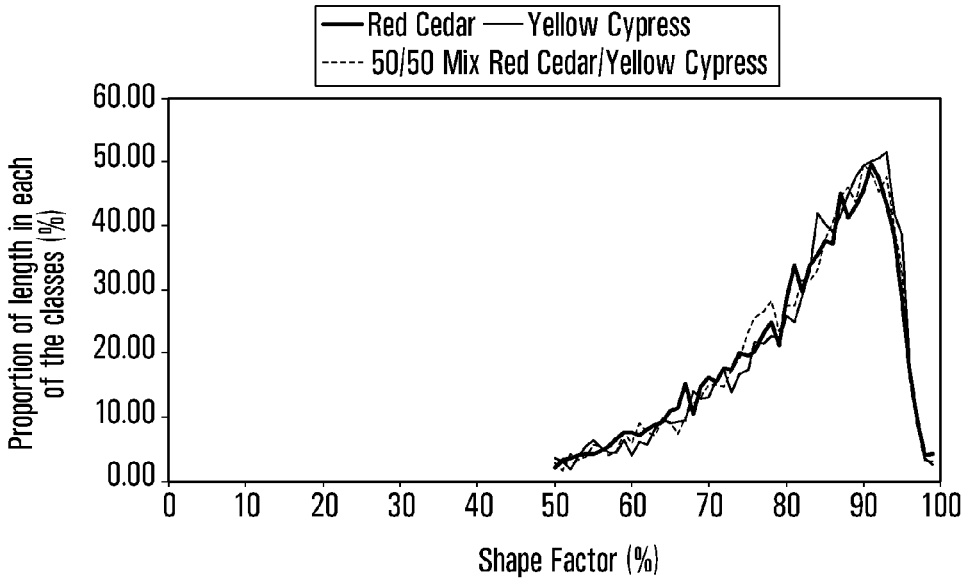
FIG. 18 shows the L&W Fibre Tester shape factor distribution for WRC, Yellow Cypress, and the 50/50 WRC/Yellow Cypress pulps.

The shape factor distribution shows Yellow Cypress had the most fibers with a shape factor of 90% (FIG. 18).

TABLE 10

Average Bleached Pulp Fiber Properties

| Sample | LW Fiber Length (mm) | Coarseness (mg/m) | % Fines | Kink Index | Shape |
|---|---|---|---|---|---|
| WRC | 2.233 | 0.110 | 28.1 | 1.769 | 82.047 |
| Yellow Cypress | 2.151 | 0.104 | 25.2 | 1.876 | 82.891 |
| 50/50 WRC/Yellow Cypress | 2.243 | 0.104 | 23.7 | 1.859 | 82.408 |
| HS 400 | 2.172 | 0.111 | 30.5 | 1.414 | 85.380 |
| HS 440 | 2.2675 | 0.124 | 50.6 | 1.607 | 84.338 |

Pulp Quality

The pulp quality results obtained from the PFI Mill processed pulps are indicated in FIGS. 19 to 27

Figure 19:
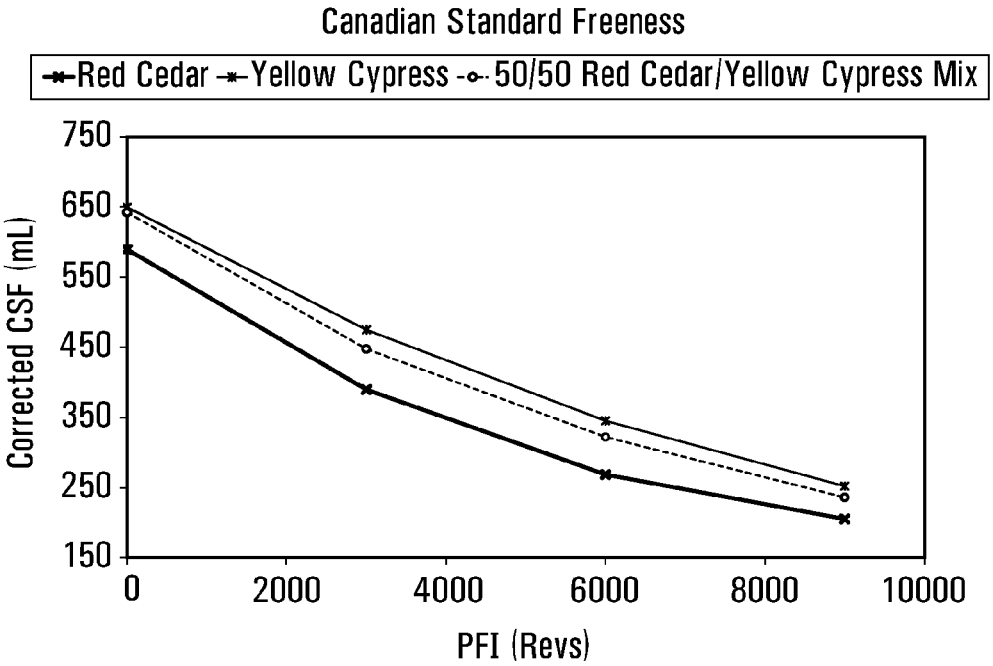
FIG. 19 shows the corrected Canadian Standard Freeness as a function of PFI beating for WRC, Yellow Cypress, and 50/50 WRC/Yellow Cypress pulps.

The 50/50 Mix generally had higher CSF than WRC for each revolution point tested (FIG. 19). The fines content as reported in Table 10 correlate with the CSF values reported in FIG. 19.

Figure 20:
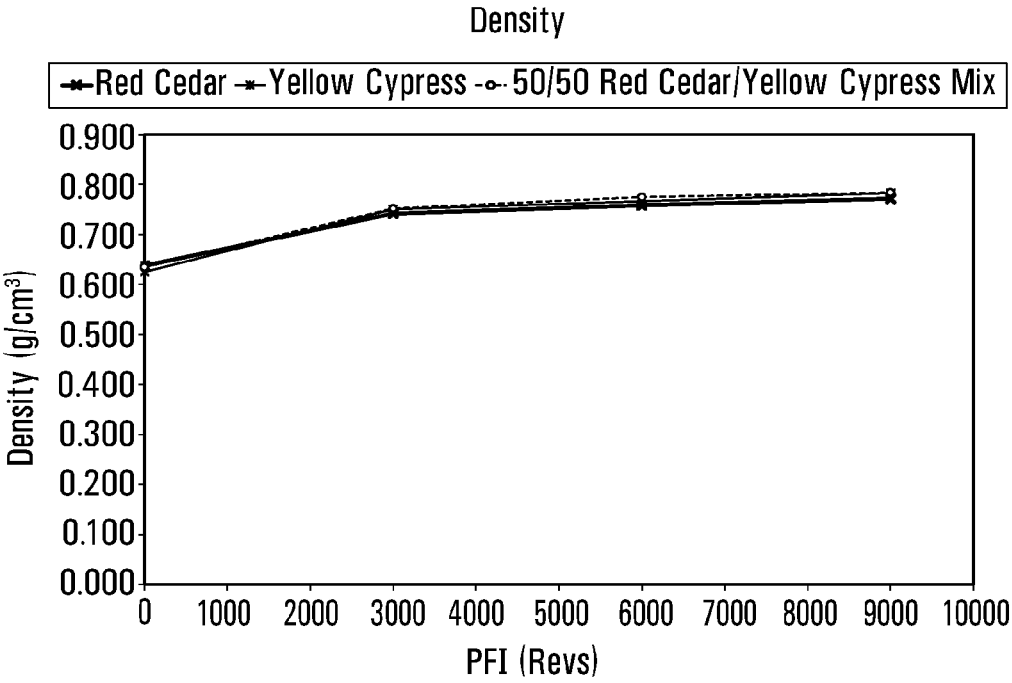
FIG. 20 shows the density as a function of PFI beating for WRC, Yellow Cypress, and 50/50 WRC/Yellow Cypress pulps.

The WRC, Yellow Cypress, and the 50/50 Mix had higher similar densities (FIG. 20).

Figure 21:
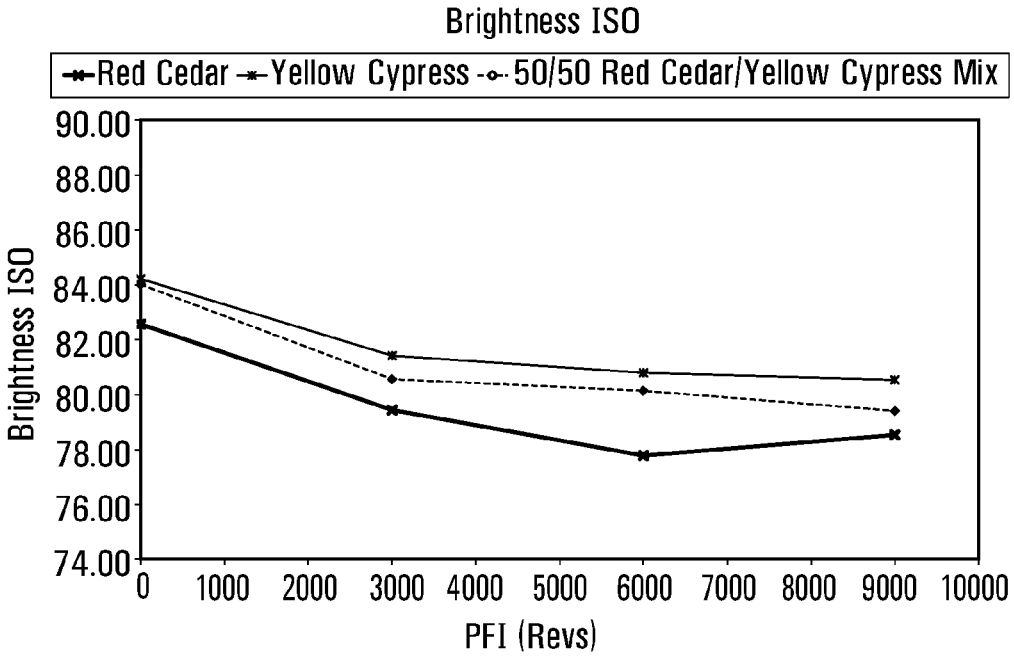
FIG. 21 shows brightness as a function of PFI beating for WRC, Yellow Cypress, and 50/50 WRC/Yellow Cypress pulps.

The final brightness of WRC, Yellow Cypress, and the 50/50 Mix were lower than the targeted ISO 86 brightness (FIG. 21). Yellow Cypress showed the highest brightness while WRC had the lowest resulting brightness out of the three test samples.

Figure 22:
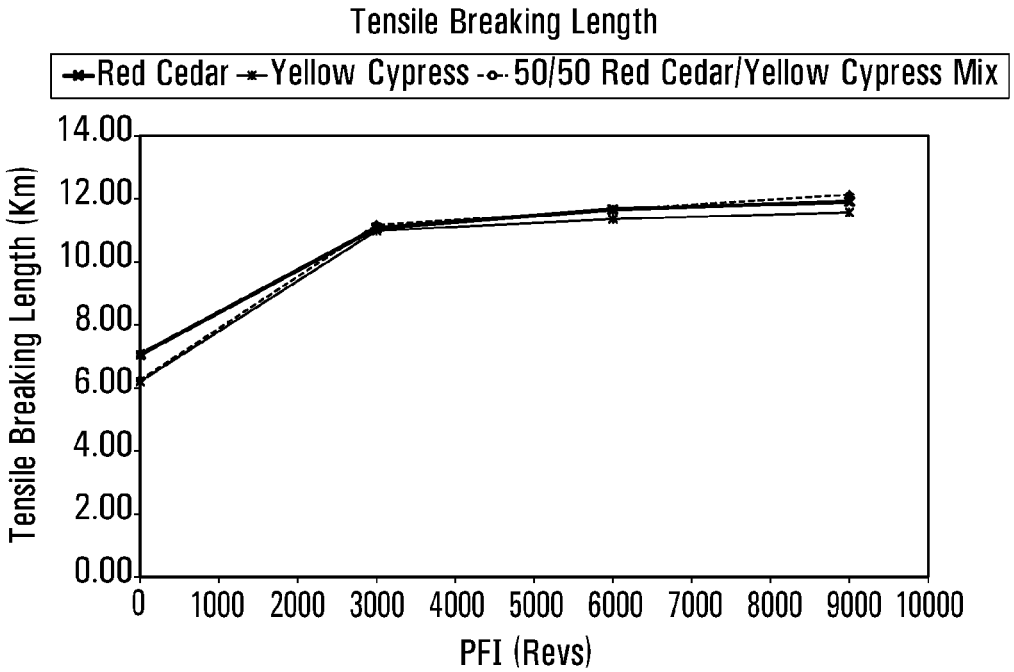
FIG. 22 shows the tensile breaking length as a function of PFI beating for WRC, Yellow Cypress, and 50/50 WRC/Yellow Cypress pulps.

WRC, Yellow Cypress, and the 50/50 Mix samples had similar tensile breaking length values for any given level of PFI refining (FIG. 22).

Figure 23:
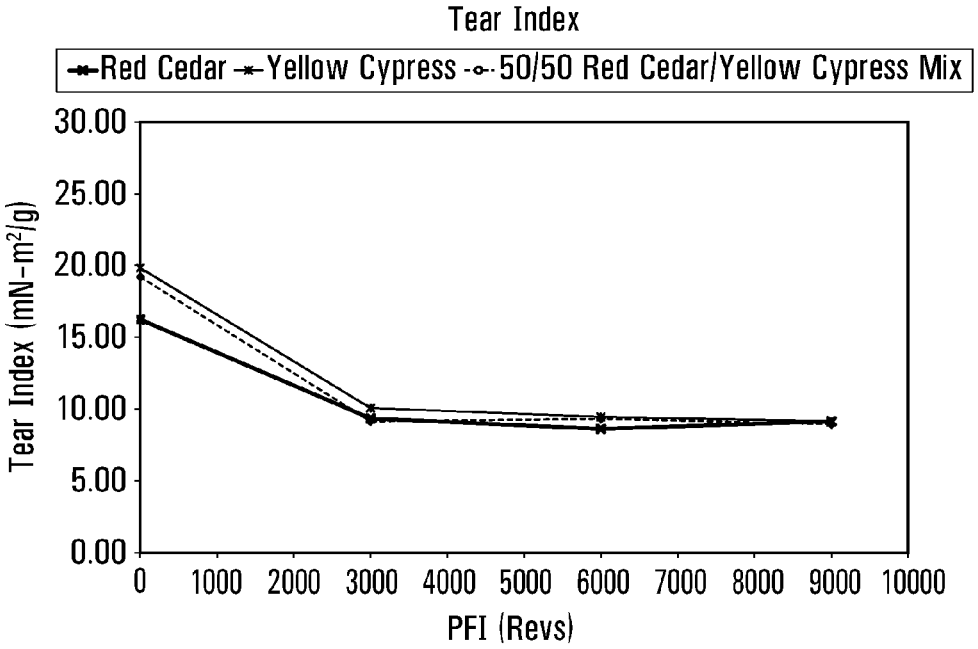
FIG. 23 shows the tear index as a function of PFI beating for WRC, Yellow Cypress, and 50/50 WRC/Yellow Cypress pulps.

Yellow Cypress and the 50/50 Mix had higher tear indices than WRC at lower PFI revolutions (FIG. 23). As the samples near 3000 and 6000 revolutions, the disparity between the samples decreased.

Figure 24:
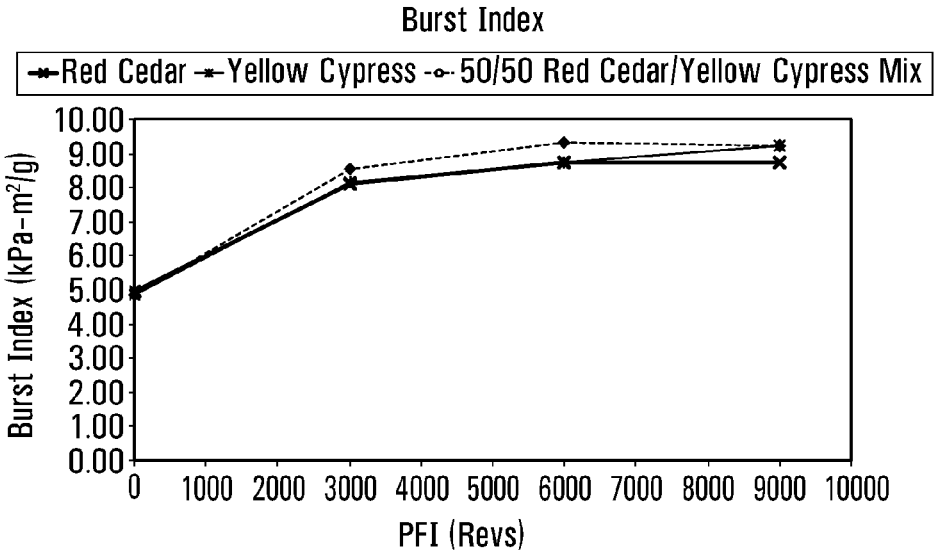
FIG. 24 shows the burst index as a function of PFI beating for WRC, Yellow Cypress, and 50/50 WRC/Yellow Cypress pulps.

WRC and Yellow Cypress showed almost identical burst strengths (FIG. 24). The 50/50 Mix had the highest burst strength.

Figure 25:
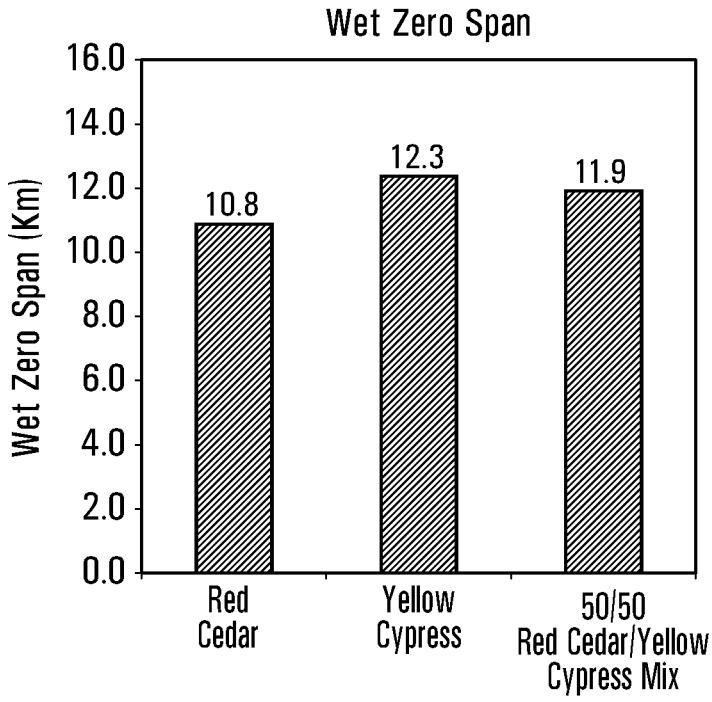
FIG. 25 is a histogram showing the Wet Zero Span for WRC, Yellow Cypress, 50/50 and 50/50 WRC/Yellow Cypress pulps.
Figure 26:
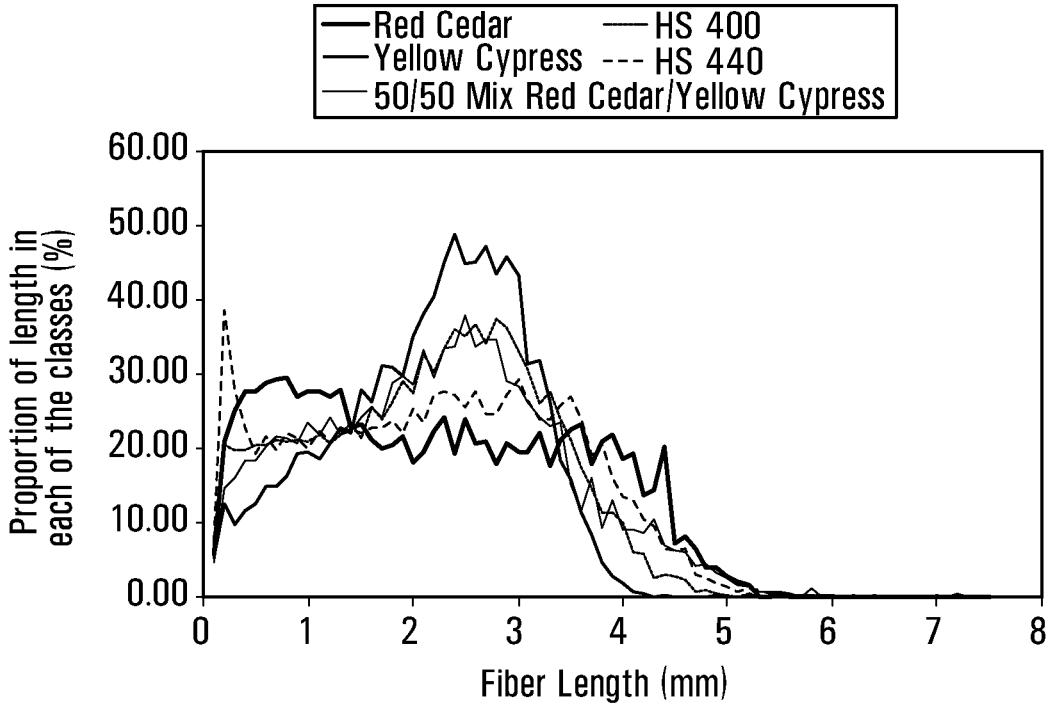
FIG. 26 shows the L&W Fibre Tester fiber length distribution of WRC, Yellow Cypress, 50/50 WRC/Yellow Cypress pulps.

WRC had the lowest wet zero-span of all samples (FIG. 25). The wet zero-span of the 50/50 Mix was only slightly less than the Yellow Cypress. WRC has the longest fibers with lengths between 3.5 to 5.5 mm, while Yellow Cypress has the most fibers within the 1.5 and 3.5 mm range (FIG. 26).

Figure 27:
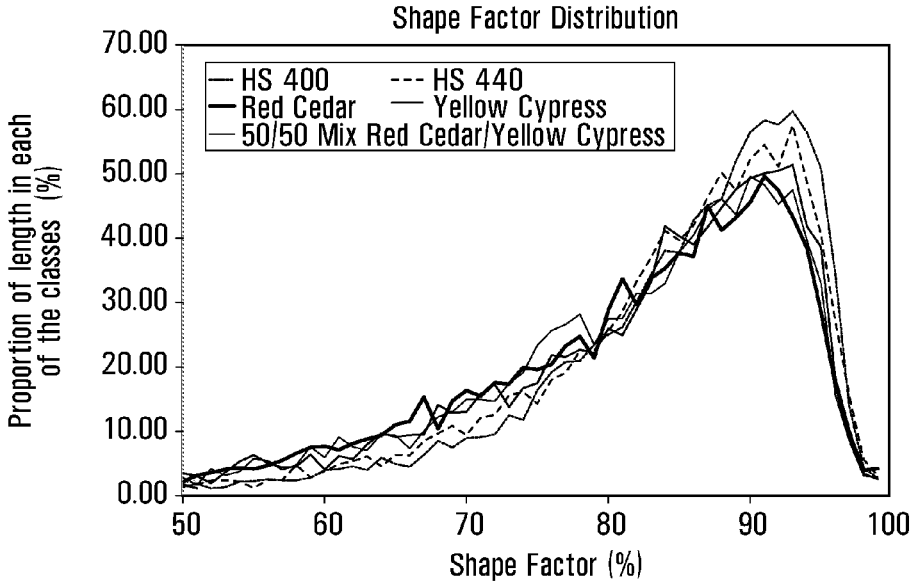
FIG. 27 shows the L&W Fibre Tester shape factor distribution of WRC, Yellow Cypress, 50/50 WRC/Yellow Cypress.

The WRC, Yellow Cypress, and the 50/50 Mix pulps had very similar shape factor distributions (FIG. 27).

Example 3

Continuous Cook

A 50/50 mix of WRC and Yellow Cypress chip furnishes was processed in an Ahlstrom Kamyr Extended Modified Continuous Cook (EMCC) digester running in downflow mode and two stage medium consistency oxygen delignification system at Howe Sound Pulp and Paper. The resulting pulp is herein referred to as "HS480". The manufacturing conditions are reported in Tables 3, 4, and 5.

Fiber measurements of HS480, as aided by confocal microscopy, are reported in Table 11. The fiber properties of HS480 pulp are reported in Tables 12 and 13.

Figure 28:
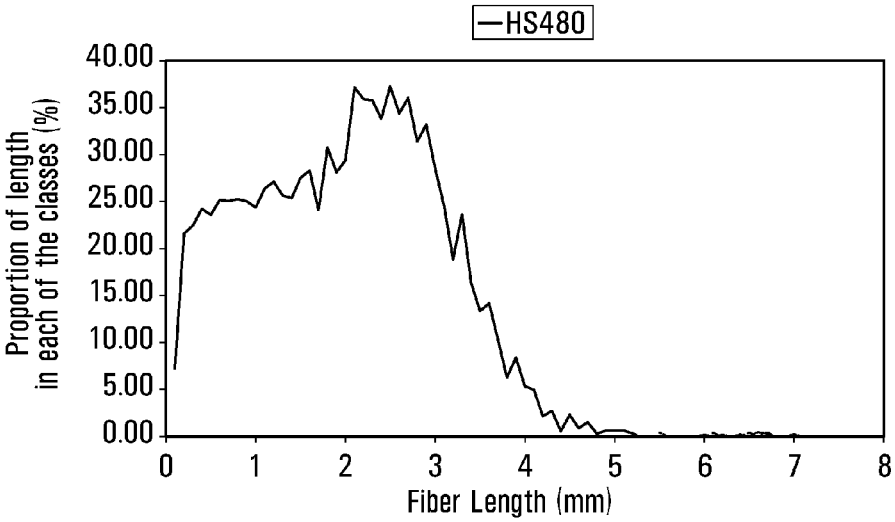
FIG. 28 shows the L&W Fibre Tester fiber lengths distribution of HS-480 pulp.
Figure 29:
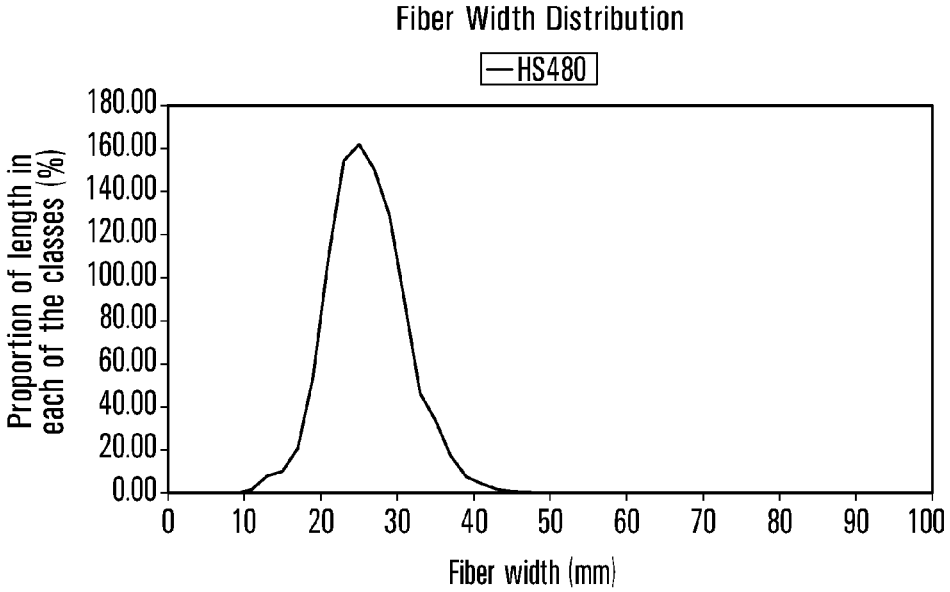
FIG. 29 shows the L&W Fibre Tester fiber width distribution of HS-480 pulp.

The fiber length distribution of HS-480 pulp is depicted in FIG. 28. The fiber width distribution is depicted in FIG. 29.

Figure 30:
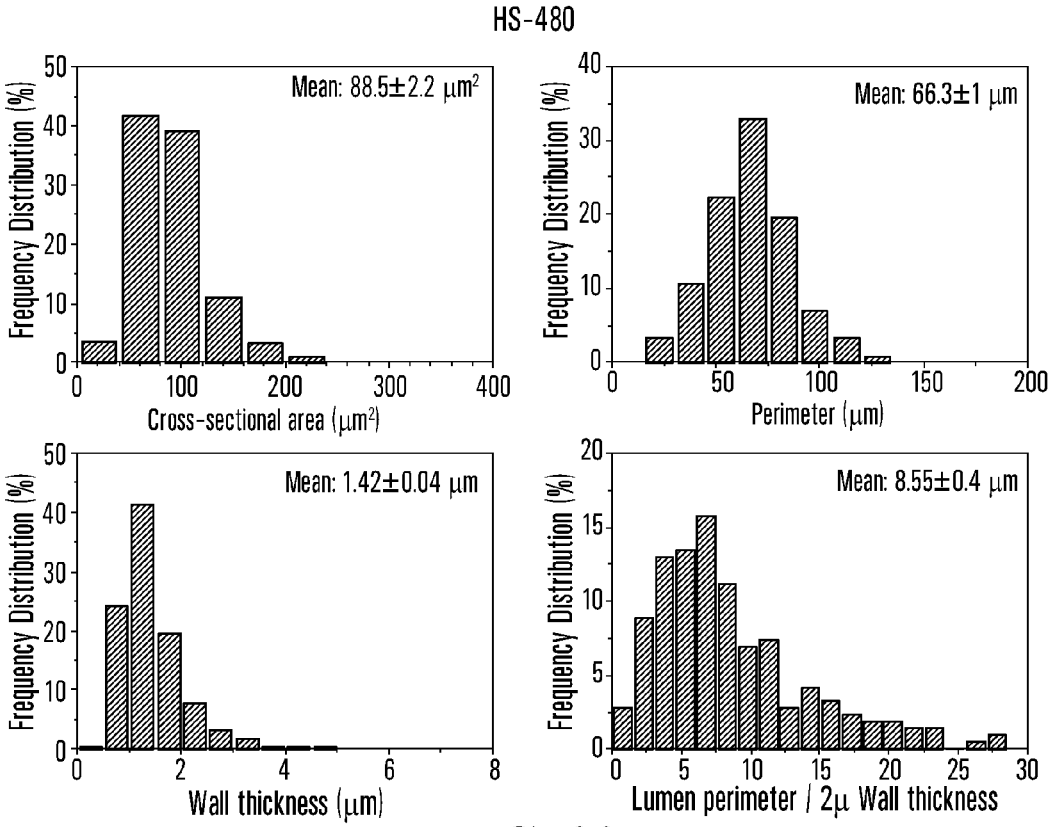
FIG. 30 is a series of histograms showing the L&W Fibre Tester fiber property distributions of HS-480 pulp.

FIG. 30 reports the fiber property distributions of HS480 pulp as determined by confocal microscopy.

TABLE 11

Average fiber properties for HS 480.

| | Mean | Min | Max | SD | Sample_SD |
|---|---|---|---|---|---|
| A (μm2) | 88.4581 | 25.5057 | 226.1656 | 32.8115 | 2.2377 |
| P (μm) | 66.3396 | 22.6062 | 121.3298 | 19.6315 | 1.3389 |
| T (μm) | 1.4228 | 0.497 | 4.7586 | 0.645 | 0.044 |
| LA (μm) | 6.8082 | 0 | 131.827 | 16.8845 | 1.1515 |
| Dmax (μm) | 32.8316 | 12.1576 | 60.091 | 9.6519 | 0.6583 |
| Dmin (μm) | 5.5474 | 1.0707 | 16.5979 | 2.4694 | 0.1684 |
| FT (μm) | 3.1211 | 0.9494 | 10.7767 | 1.6754 | 0.1143 |
| AR (μm) | 0.1938 | 0.0319 | 0.7548 | 0.1288 | 0.0088 |
| C1 | 0.9341 | 0 | 1 | 0.1841 | 0.0126 |
| C2 | 0.8593 | 0 | 1 | 0.2739 | 0.0187 |
| RA | 174.5381 | 29.0889 | 551.3673 | 77.1214 | 5.2596 |
| TA | 95.2663 | 25.5057 | 357.9926 | 42.8802 | 2.9244 |
| LA % | 4.748 | 0 | 50.3326 | 9.5126 | 0.6488 |
| LP (μm) | 60.3709 | 14.7973 | 119.1196 | 20.7038 | 1.412 |
| CL (μm) | 53.5359 | 0 | 119.1196 | 25.6076 | 1.7464 |

TABLE 11-continued

| Average fiber properties for HS 480. | | | | | |
|---|---|---|---|---|---|
| | Mean | Min | Max | SD | Sample_SD |
| UCL (μm) | 6.835 | 0 | 66.744 | 12.6969 | 0.8659 |
| OFP (μm) | 72.9764 | 27.5142 | 124.9682 | 18.5732 | 1.2667 |
| FC | 0.2546 | 0.0666 | 0.846 | 0.1456 | 0.0099 |
| Z | 23.4471 | 6.6621 | 80.0828 | 11.6069 | 0.7916 |

A Fiber wall cross-sectional area
P Fiber centre-line perimeter
T Fiber wall thickness
LA Lumen area
Dmax Fiber width, longest Feret diameter
Dmin Fiber thickness, shortest Feret diameter
FT Fiber thickness = (A + LA)/Dmax
AR Aspect ratio, Dmin/Dmax
C1 Collapse index, 1 − LA/LAo
C2 1 − collapsed lumen perimeter/original lumen perimeter
LP Lumen perimeter
CL Collapsed lumen perimeter
UCL Uncollapsed lumen perimeter
OFP Outer fiber perimeter
FC Form circle
Z z-parameter

TABLE 12

| Average fiber properties of HS 480. | |
|---|---|
| | HS-480 |
| Fiber wall cross sectional area ($\mu m^2$) | 88 +/− 2 |
| Fiber perimeter (μm) | 66 +/− 1 |
| Fiber wall thickness (μm) | 1.42 +/− 0.04 |
| Lumen perimeter (μm) | 8.5 +/− 0.4 |
| Aspect ratio (Dmin/Dmax) | 0.19 +/− 0.01 |
| Collapse Index (1 − $LA/LA_o$) | 0.93 +/− 0.01 |
| Fines (%) | 0.110 |

TABLE 13

| Average fiber properties of HS 480. | | | | |
|---|---|---|---|---|
| LW Fiber Length (mm) | Coarsness (mg/m) | Canadian Standard Freeness | Tensile breaking length at 500 Csf | Porosity (Gurley sec at 500 Csf |
| 2.002 | 0.110 | 598 | 8.40 | 26.4 |

Figure 31:
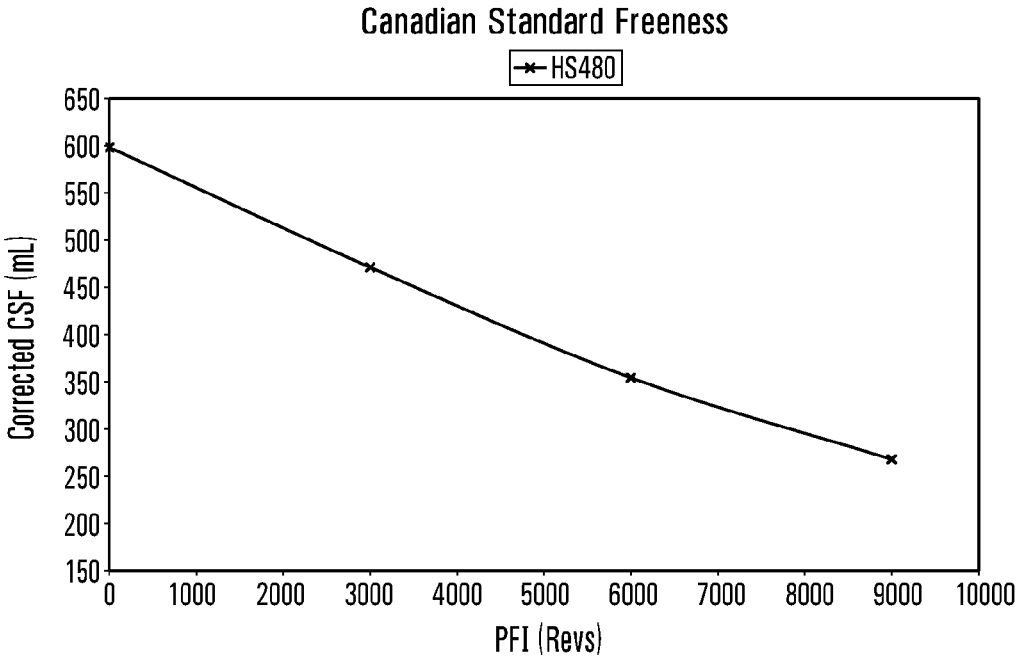
FIG. 31 shows the Canadian Standard Freeness of HS-480 pulp as a function of PFI.
Figure 32:
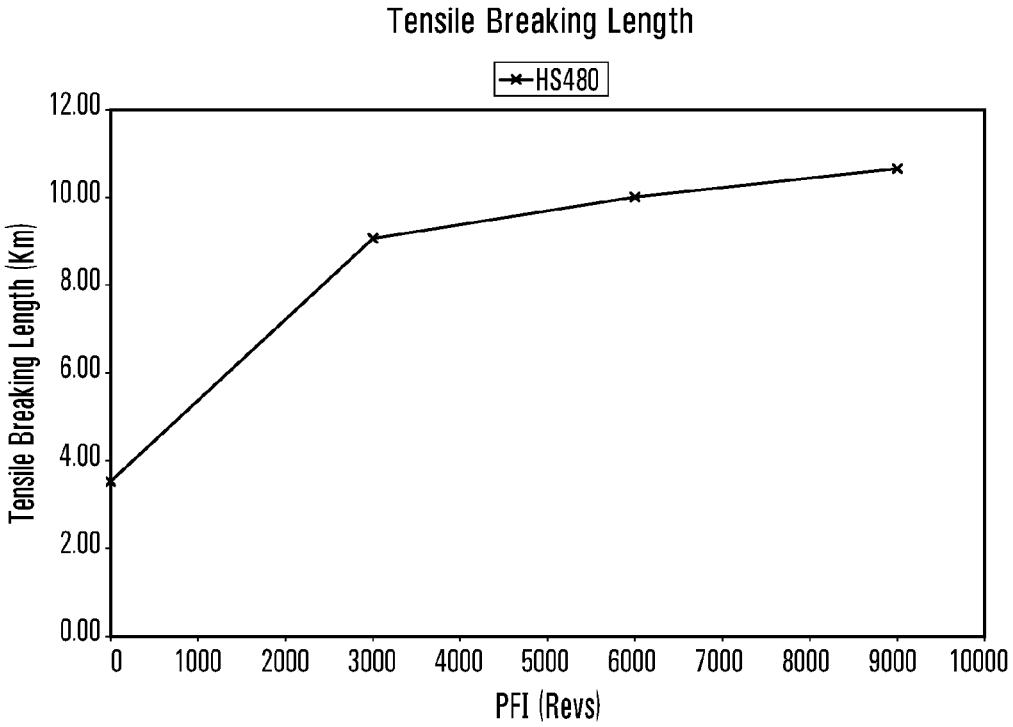
FIG. 32 shows the tensile breaking lengths of HS-480 pulp as a function of PFI.
Figure 33:
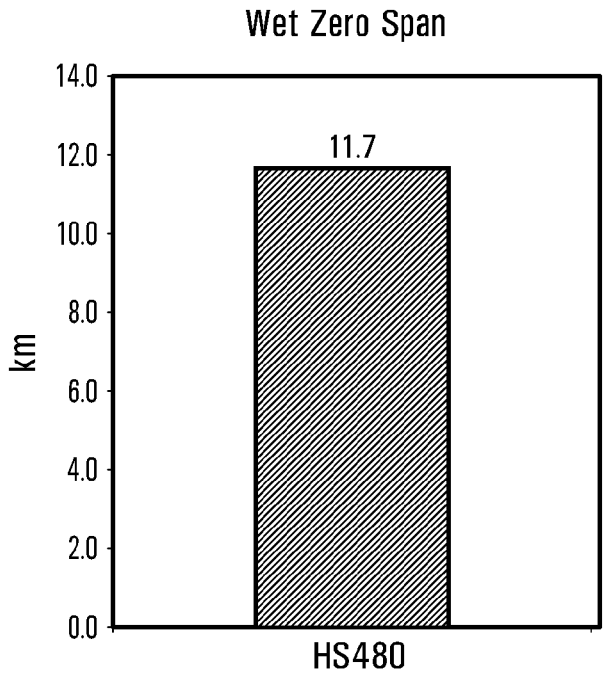
FIG. 33 is a histogram showing the Wet Zero Span of HS-480 pulp.
Figure 34:
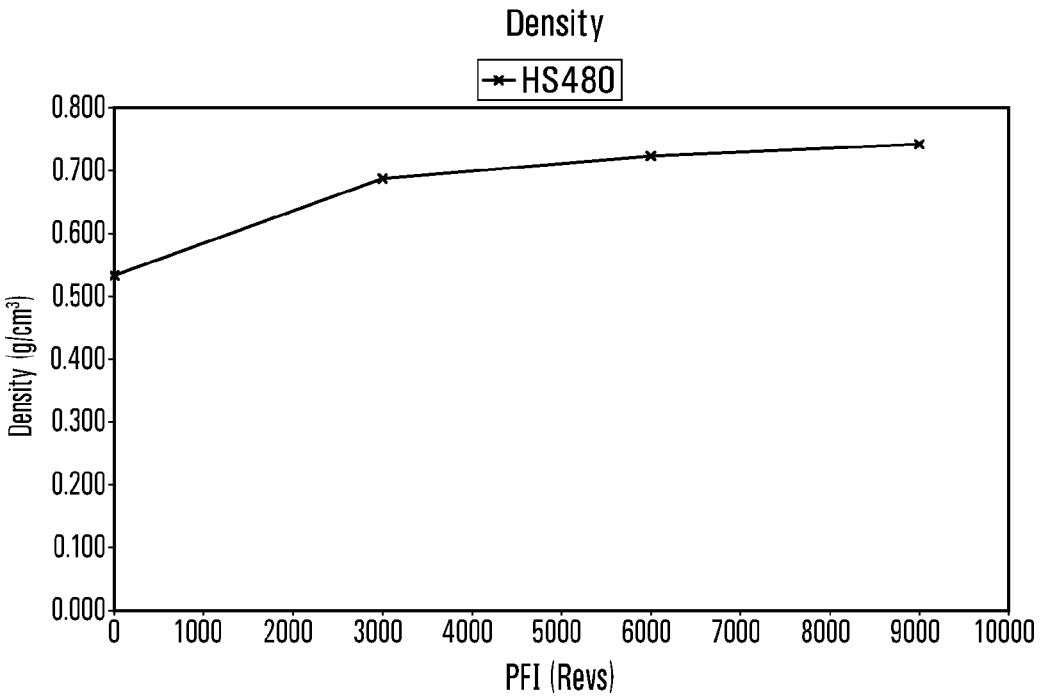
FIG. 34 shows the density of HS-480 pulp as a function of PFI beating.
Figure 35:
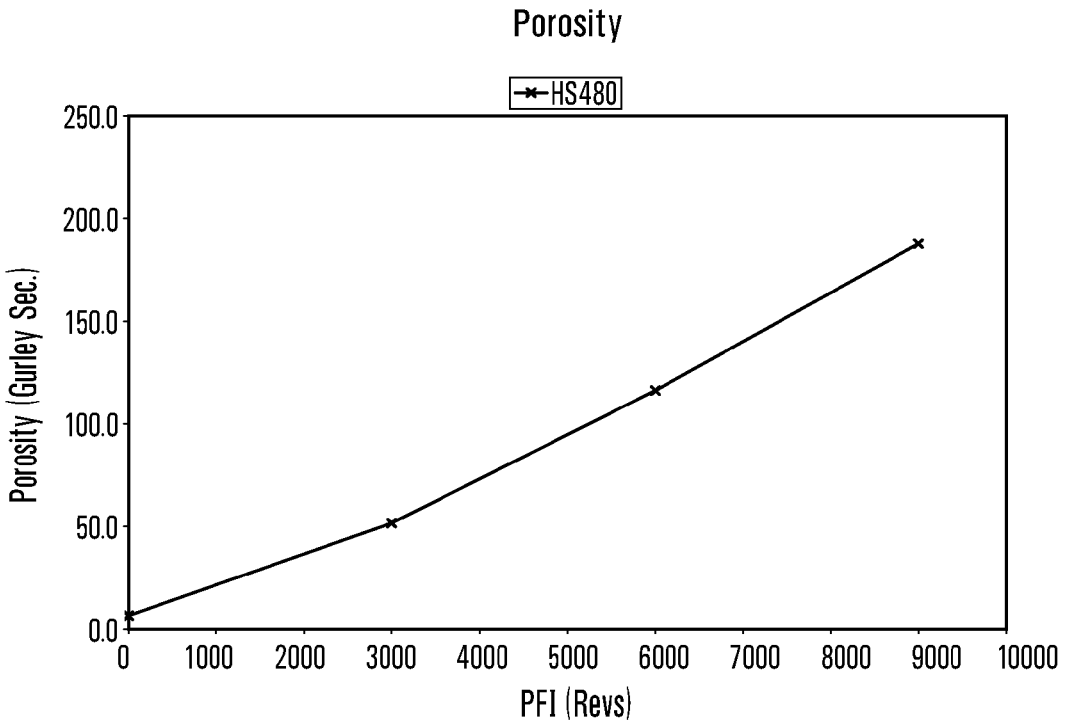
FIG. 35 shows the sheet porosity of HS-480 pulp as a function of PFI beating.
Figure 36:
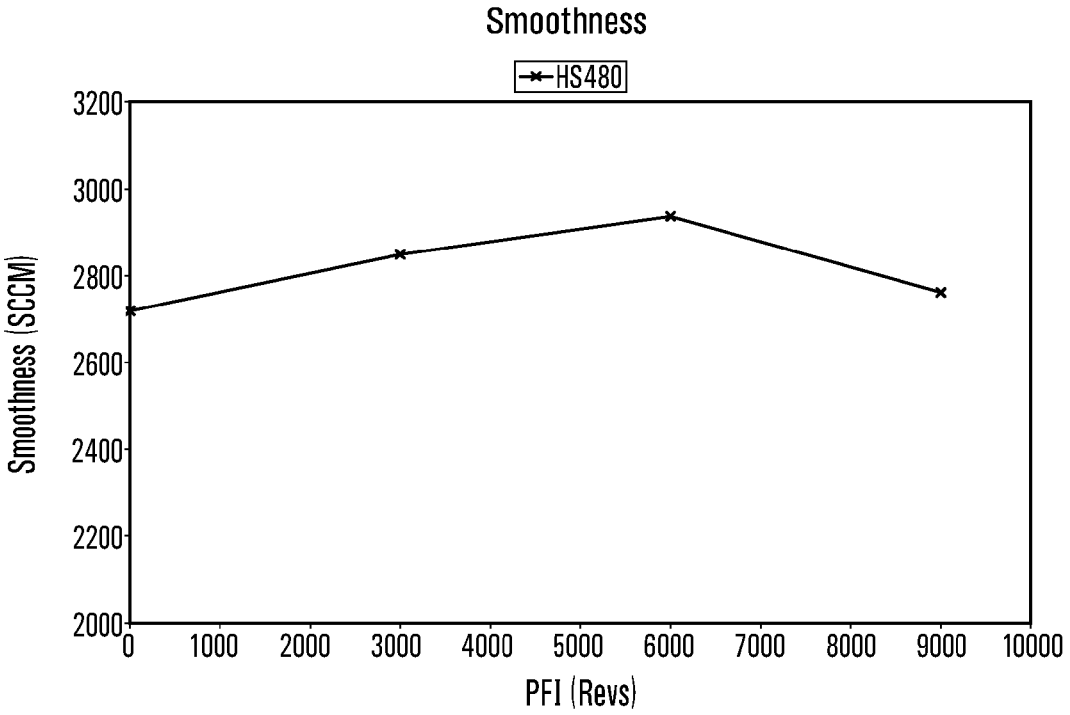
FIG. 36 shows the smoothness of HS-480 pulp as a function of PFI beating.
Figure 37:
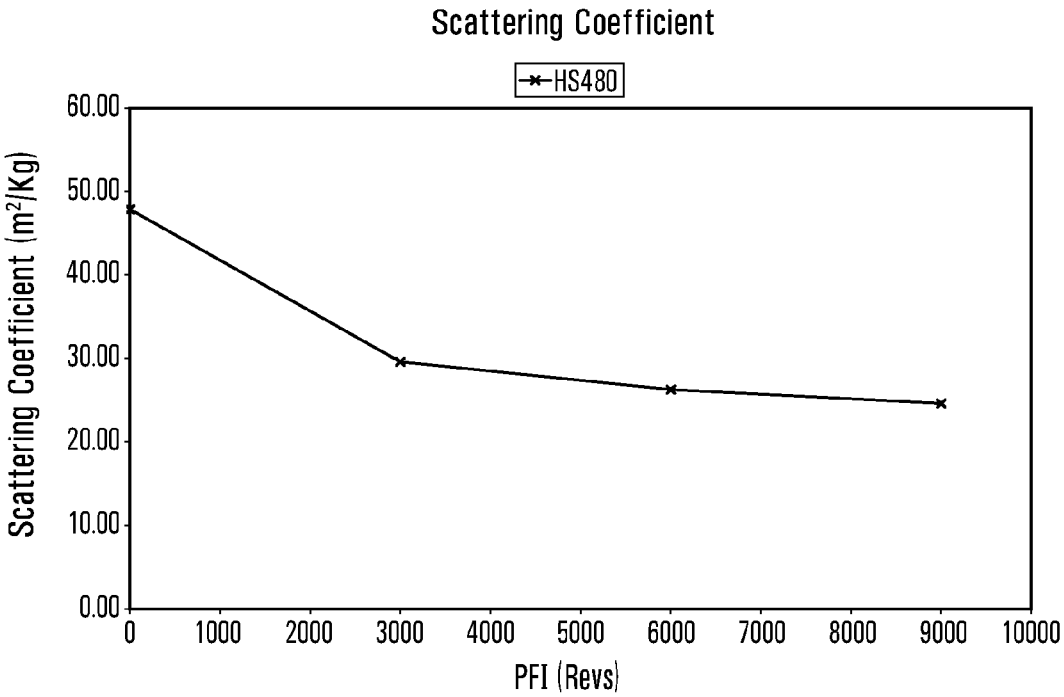
FIG. 37 shows the scattering coefficient of HS-480 pulp as a function of PFI beating.
Figure 38:
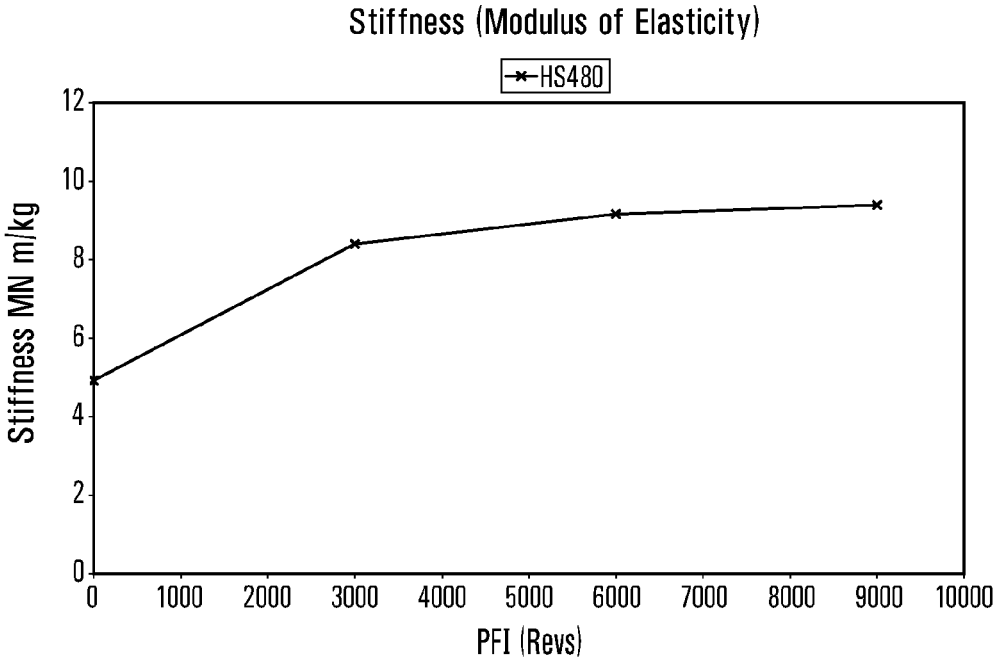
FIG. 38 shows the stiffness of HS-480 pulp as a function of PFI beating.
Figure 39:
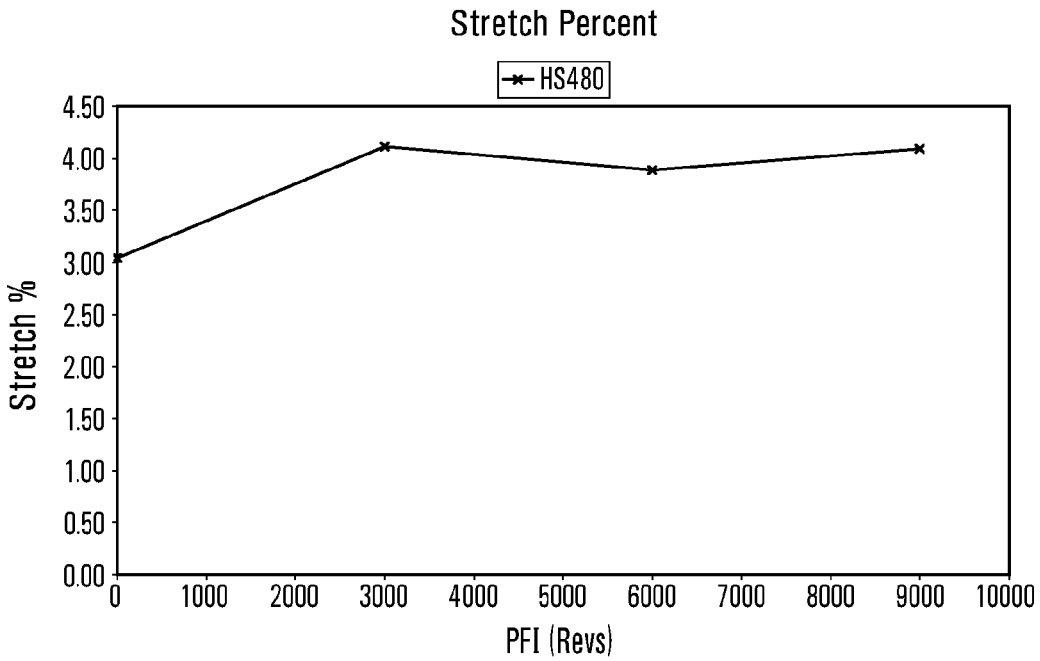
FIG. 39 shows the stretch of HS-480 and pulp as a function of PFI beating.

The freeness and tensile breaking length of HS480 are depicted in FIGS. 31 and 32. The Wet Zero Span measurements of HS480 are depicted in FIG. 33. The density of HS480 is depicted in FIG. 34. Sheet porosity is depicted in FIG. 35. The smoothness of HS480 is depicted in FIG. 36. Light scattering of HS 480 is depicted in FIG. 37. The stiffness of HS480 is depicted in FIG. 38. Finally, HS480 stretch values are depicted FIG. 39.

What is claimed is:

1. A continuous process for delignifying lignocellulosic material, the process comprising:

feeding a lignocellulosic blend comprising a *Thuja plicata* chip furnish and a second lignocellulosic material that is a *Callitropsis nootkatensis* chip furnish into an aqueous alkaline pulping solution at a feed end of a digester, to produce a lignocellulosic mass, wherein the *Truja plicata* chip furnish comprises at least 50% of the blend by oven dry weight, wherein the second lignocellulosic material is provided in a proportion that increases the density of the mass so that the mass sinks in the pulping solution so as to move the mass through the digester to produce a cellulosic pulp under conditions having an H-Factor of 1500 or greater; and recovering the cellulosic pulp at a recovery end of the digester, wherein the cellulosic pulp may be subsequently bleached to produce a bleached pulp having:

a. a post-bleaching kappa of 5 or less;

b. a yield of 38% or more;

c. an average length weighted fiber length of 2.2 mm or less;

d. a coarseness of 0.16 mg/m or less;

e. a freeness of 610 mL or greater;

f. a tensile strength of 8.0 m or more at 500 Csf; and g. a porosity of 60 Gurley sec. or less at 500 Csf.

2. The continuous process of claim 1, further comprising bleaching the cellulosic pulp to produce a bleached pulp having:

a. a post-bleaching kappa of 5 or less;

b. an average length weighted fiber length of 2.2 mm or less;

c. a coarseness of 0.16 mg/m or less;

d. a freeness of 610 mL or less;

e. a tensile strength of 8.0 km or more at 500 Csf; and f. a porosity of 60 Gurley sec. or less at 500 Csf.

3. The continuous process according to claim 2, wherein the post-bleaching kappa is greater than zero.

4. The continuous process according to either claim 2, wherein the average length weighted fiber length is 1.8 mm or greater.

5. The continuous process according to claim 2, wherein the freeness is 550 mL or greater.

6. The continuous process according to claim 2, wherein the tensile strength is 9.5 km or less at 500 Csf.

7. The continuous process according to claim 2, wherein the porosity is 20 Gurley sec. or greater at 500 Csf.

8. A cellulosic pulp prepared according to the process of claim 2, wherein the cellulosic pulp has been bleached to produce a bleached pulp having any one or more of:

a. a post-bleaching kappa 5 or less;

b. a yield of 38% or greater;

c. an average length weighted fiber length of 2.2 mm or less;

d. a coarseness of 0.16 mg/m or less;

e. a freeness of 610 mL or greater;

f. a tensile strength of 8.0 km or greater at 500 Csf; and g. a porosity of 60 Gurley sec. or less at 500 Csf.

9. The continuous process of claim 1, wherein 50%-80% of the fibers comprising the cellulosic pulp are *Thuja plicata* fibers.

10. The continuous process of claim 1, wherein the *Thuja plicata* comprises 50%-80% of the blend by oven dry weight.

11. A process for delignifying lignocellulosic material, comprising:

feeding a lignocellulosic blend comprising a *Thuja plicata* chip furnish and a second lignocellulosic material that is a *Callitropsis nootkatensis* chip furnish into an aqueous alkaline pulping solution in a digester to produce a lignocellulosic mass, wherein the *Truja plicata* chip furnish comprises 50%-85% of the blend by oven dry weight, to produce a cellulosic pulp under conditions having an H-Factor of 1500 or greater; and recovering the cellulosic pulp from the digester, wherein the cellulosic pulp has:

a. a kappa of 30 or less;

b. a yield of 38% or greater.

12. The process according to claim 11, further comprising bleaching the cellulosic pulp.

13. The process according to claim 11, further comprising bleaching the cellulosic pulp to produce a bleached pulp having:

a. a post-bleaching kappa of 5 or less;

b. an average length weighted fiber length of 2.2 mm or less;

c. a coarseness of 0.16 mg/m or less;

d. a freeness of 610 mL or less;

e. a tensile strength of 8.0 km or more at 500 Csf; and f. a porosity of 60 Gurley sec. or less at 500 Csf.

14. The process according to claim 13, wherein the post-bleaching kappa is greater than zero.

15. The process according to claim 13, wherein the length weighted fiber length is 1.8 mm or greater.

16. The process according to claim 13, wherein the freeness is 500 mL or greater.

17. The process according to claim 13, wherein the tensile strength is 9.5 km or less at 500 Csf.

18. The process according to claim 13, wherein the porosity is 20 Gurley sec. or greater at 500 Csf.

19. The process according to claim 18, wherein 50%-80% of the fibers comprising the cellulosic pulp are *Thuja plicata* fibers.

20. The process according to claim 11, wherein the process is a continuous process.

21. The process according to claim 20, wherein the *Thuja plicata* chip furnish comprises 80% or less of the blend by oven dry weight.

22. A cellulosic pulp prepared according to the process of claim 11, wherein the cellulosic pulp has:

a. a kappa 5 or less; and b. a yield of 38% or greater.

* * * * *